US007614712B2

(12) United States Patent
Kachi

(10) Patent No.: US 7,614,712 B2
(45) Date of Patent: Nov. 10, 2009

(54) IMAGE RECORDING APPARATUS

(75) Inventor: Yasuhiko Kachi, Kanagawa (JP)

(73) Assignee: Fujifilm Corp., Tokyo (JP)

( * ) Notice: Subject to any disclaimer, the term of this patent is extended or adjusted under 35 U.S.C. 154(b) by 285 days.

(21) Appl. No.: 11/093,289

(22) Filed: Mar. 30, 2005

(65) Prior Publication Data

US 2005/0219293 A1 Oct. 6, 2005

(30) Foreign Application Priority Data

Mar. 31, 2004 (JP) ..... 2004-107672

(51) Int. Cl.
*B41J 29/38* (2006.01)

(52) U.S. Cl. ..... 347/14; 347/102

(58) Field of Classification Search ..... 347/102, 347/40–43, 14, 101
See application file for complete search history.

(56) References Cited

U.S. PATENT DOCUMENTS

| | | | | |
|---|---|---|---|---|
| 5,502,475 | A * | 3/1996 | Kaburagi et al. | 347/102 |
| 5,784,090 | A * | 7/1998 | Selensky et al. | 347/102 |
| 5,861,900 | A * | 1/1999 | Lu et al. | 347/43 |
| 5,923,348 | A * | 7/1999 | Cunnagin et al. | 347/42 |
| 7,014,309 | B2 * | 3/2006 | Aukerman | 347/102 |
| 7,316,476 | B2 * | 1/2008 | Yokoyama | 347/102 |
| 2003/0063172 | A1 | 4/2003 | Ohtsu et al. | |
| 2003/0184632 | A1 | 10/2003 | Suzuki et al. | |

FOREIGN PATENT DOCUMENTS

| | | | |
|---|---|---|---|
| JP | 3-247450 | A | 11/1991 |
| JP | 4-173250 | A | 6/1992 |
| JP | 2000-71481 | A | 3/2000 |
| JP | 2002-248745 | A | 9/2002 |
| JP | 2003-159791 | A | 6/2003 |
| JP | 2003-285426 | A | 10/2003 |
| JP | 2004-001437 | A | 1/2004 |
| JP | 2004-42548 | A | 2/2004 |
| JP | 2004-50706 | A | 2/2004 |

* cited by examiner

*Primary Examiner*—Thinh H Nguyen
(74) *Attorney, Agent, or Firm*—Birch, Stewart, Kolasch & Birch, LLP

(57) ABSTRACT

An image recording apparatus having a plurality of nozzle rows of respective colors each having a plurality of nozzles arranged independently for each of inks of the respective colors, the plurality of nozzles discharging the inks onto a recording medium. A conveyance device performs conveyance of the recording medium in a relative conveyance direction relatively with respect to the plurality of nozzle rows and a fixing device fixes the inks deposited on the recording medium from the plurality of nozzles to the recording medium.

A relative conveyance velocity control device controls a relative conveyance velocity V of the recording medium in the relative conveyance with respect to the plurality of nozzle rows and a fixing control device controls a fixing energy of the fixing device in such a manner to satisfy a relationship S/V>t1, where t1 is a fixing time and S is the nozzle row separation distance.

15 Claims, 14 Drawing Sheets

| MEASUREMENT ITEM | EVALUATION METHOD | RELATIONSHIP TO IMAGE QUALITY |
|---|---|---|
| σd | SMALLEST VALUE OF σd | GOOD RESOLUTION WITH RESPECT TO COLOR MIXING |
| av(d) | SMALLEST VALUE OF av(d) | GOOD REPRODUCIBILITY OF MIDRANGE COLORS, AND GOOD RESOLUTION WITH RESPECT TO COLOR MIXING |

FIG.16

| MEASUREMENT ITEM | TARGET VALUE | CORRECTION FACTOR | WEIGHTING FACTOR |
|---|---|---|---|
| $\sigma d$ | 0 | $a_1 \fallingdotseq 10$ | $b_1$ |
| av(d) | LENGTH OF OVERLAP = D | $a_2 \fallingdotseq 3$ | $b_2$ |

FIG.17

| IMAGE QUALITY MODE | $b_1$ | $b_2$ |
|---|---|---|
| TEXT + IMAGES | 1 | 1 |
| IMAGES | 2 | 1 |

IMAGE RECORDING APPARATUS

BACKGROUND OF THE INVENTION

1. Field of the Invention

The present invention relates to an image recording apparatus, and more particularly, to an image recording apparatus for recording images by discharging ink from a plurality of nozzles toward a recording medium, in which color mixing of inks is prevented.

2. Description of the Related Art

Conventionally, an image recording apparatus (inkjet printer) is known, which comprises an inkjet head (ink discharge head) having an arrangement of a plurality of nozzles and which records images on a recording medium by discharging ink from the nozzles while causing the inkjet head and the recording medium to move relatively to each other.

Various methods are known conventionally as ink discharge methods for an inkjet recording apparatus of this kind. For example, one known method is a piezoelectric method, where the volume of a pressure chamber (ink chamber) is changed by causing a vibration plate forming a portion of the pressure chamber to deform due to deformation of a piezoelectric element (piezoelectric ceramics), ink being introduced into the pressure chamber from an ink supply passage when the volume is increased, and the ink inside the pressure chamber being discharged as a droplet from the nozzle when the volume of the pressure chamber is reduced. Another known method is a thermal inkjet method where ink is heated to generate a bubble in the ink, and ink is then discharged by means of the expansive energy created as the bubble grows.

In an image recording apparatus having an ink discharge head such as an inkjet recording apparatus, ink is supplied to the ink discharge head from an ink tank storing ink, via ink supply channels, and ink is discharged by one of the various methods described above. However, in cases where a color image is recorded by using a plurality of inks of different colors, then if an ink of one color is recorded in an overlapping fashion onto ink of a different color recorded previously, before that ink has fixed and hardened, then color mixing occurs and image quality declines.

Therefore, conventionally, various methods have been proposed in order to prevent color mixing and thus improve image quality, when inks of different colors are recorded in an overlapping fashion.

In one known example, ink dots of respective colors ejected from respective color recording heads are recorded during one rotation of a rotating body supporting the recording medium, in a thinned-out fashion whereby the dots are separated by at least one dot space in the sub-scanning direction, which coincides with the direction of rotation of the recording medium (see, for example, Japanese Patent Application Publication No. 2000-71481). Therefore, mixing and spreading of adjacent ink dots is prevented, while achieving high-quality image recording.

In a further example, an inkjet recording apparatus comprises a device for estimating the state of drying of the recorded ink, and the recording intervals between one recording action and the next recording action are altered by changing the conveyance velocity of the recording medium and changing the interval between the recording heads, in accordance with the estimation results. In this way, it is possible to prevent recording irregularities in the regions where different inks are superimposed, while maintaining the through-put of the recording apparatus, and therefore, image quality is improved (see, for example, Japanese Patent Application Publication No. 03-247450).

Yet a further example describes a color inkjet recording method in which, in the same printing region, printing by at least one head of a plurality of heads is carried out after leaving a time period sufficiently longer than the printing delay time of the adjacent head, after the time of printing by another head. In this way, color prints which do not contain color bleeding can be obtained (see, for example, Japanese Patent Application Publication No. 04-173250).

However, in Japanese Patent Application Publication No. 2000-71481, for example, the dots are recorded in a thinned-out fashion during one rotation of the rotating body holding the recording medium, and therefore it is necessary to carry out a plurality of rotations in order to record one full image. Therefore, productivity is low.

Furthermore, Japanese Patent Application Publication No. 03-247450 comprises a device for estimating the state of drying and a device for adjusting the dot recording interval, in such a manner that the interval at which subsequent dots are recorded is adjusted in accordance with the state of drying. However, no device for fixing or curing the ink that has been deposited on the recording medium is provided, and the ink is simply left to dry naturally. Therefore, it is not possible always to prevent color mixing in a reliable fashion.

Moreover, Japanese Patent Application Publication No. 04-173250 simply sets a time period greater than the printing delay between adjacent dots, but it does not comprise a device for adjusting fixing or curing, and therefore has the same problems as Japanese Patent Application Publication No. 03-247450.

SUMMARY OF THE INVENTION

The present invention has been contrived in view of the foregoing circumstances, and an object thereof is to provide an image recording apparatus capable of preventing color mixing of inks on the surface of the recording medium, while achieving high-speed recording.

In order to attain the aforementioned object, the present invention is directed to an image recording apparatus, comprising: a plurality of nozzle rows of respective colors in each of which a plurality of nozzles are arranged independently for each of inks of the respective colors, the plurality of nozzles discharging the inks onto a recording medium; a conveyance device which performs relative conveyance of the recording medium in a relative conveyance direction relatively with respect to the plurality of nozzle rows; and a fixing device which fixes the inks deposited on the recording medium from the plurality of nozzles, wherein the image recording apparatus records an image by discharging the inks of the respective colors onto the recording medium from the plurality of nozzles while the relative conveyance by the conveyance device, and the image recording apparatus further comprises at least one of: a nozzle row separation distance control device which controls a nozzle row separation distance S between a first nozzle row and a second nozzle row which are positioned adjacently in the plurality of nozzle rows of the respective colors and which discharge the inks in a consecutive fashion; a relative conveyance velocity control device which controls a relative conveyance velocity V of the recording medium in the relative conveyance with respect to the plurality of nozzle rows; and a fixing control device which controls a fixing energy of the fixing device in such a manner that a fixing time $t_1$ required for the ink discharged from the first nozzle row to become fixed in the recording medium is a prescribed time period, wherein at least one of the nozzle row separation distance S, the relative conveyance velocity V and the fixing time $t_1$ is controlled so as to satisfy a relationship $S/V>t_1$.

According to the present invention, inks of respective colors are made to correspond to respective nozzle rows in which nozzles for discharging ink are aligned, and when the inks of respective colors are discharged from the nozzle rows onto the recording medium, by controlling the nozzle row separation distance or the relative conveyance velocity of the recording medium or the fixing time of the ink discharged onto the recording medium, the time difference between the ink discharge timings of two nozzle rows which discharge inks of different colors onto positions in which the ink dots are at least partially overlapping on the recording medium is controlled so as to be longer than the fixing time of the ink discharged from the first of these nozzle rows. Therefore, color mixing between the different inks is avoided while also permitting high-speed recording.

In order to attain the aforementioned object, the present invention is also directed to an image recording apparatus, comprising: a plurality of nozzle rows of respective colors in each of which a plurality of nozzles are arranged independently for each of inks of the respective colors, the plurality of nozzles discharging the inks onto a recording medium; a conveyance device which performs relative conveyance of the recording medium in a relative conveyance direction relatively with respect to the plurality of nozzle rows; and a curing device which cures the inks deposited on the recording medium from the plurality of nozzles, wherein the image recording apparatus records an image by discharging the inks of the respective colors onto the recording medium from the plurality of nozzles while the relative conveyance by the conveyance device, and the image recording apparatus further comprises at least one of: a nozzle row separation distance control device which controls a nozzle row separation distance S between a first nozzle row and a second nozzle row which are positioned adjacently in the plurality of nozzle rows of the respective colors and which discharge the inks in a consecutive fashion; a relative conveyance velocity control device which controls a relative conveyance velocity V of the recording medium in the relative conveyance with respect to the plurality of nozzle rows; and a curing control device which controls a curing energy of the curing device in such a manner that a curing time t2 required for the ink discharged from the first nozzle row to become cured on the recording medium is a prescribed time period, wherein at least one of the nozzle row separation distance S, the relative conveyance velocity V and the curing time t2 is controlled so as to satisfy a relationship $S/V>t2$.

In this way, even if the curing time of the ink discharged onto the recording medium is controlled, it is possible to avoid color mixing while permitting high-speed recording, similarly to the foregoing.

If the image recording apparatus comprises the relative conveyance velocity control device, it is preferable that the image recording apparatus further comprises a frequency control device which controls a discharge frequency of the nozzle rows of the respective colors in such a manner that the image is recorded with a prescribed dot pitch. Thereby, it is possible to avoid color mixing without impairing image quality, by controlling the discharge frequency in accordance with any changes made to the relative conveyance velocity of the recording medium.

Preferably, the nozzle rows constitute line heads for the inks of the respective colors, the line heads being arranged through a length corresponding to a full dimension in a width direction of the recording medium. By applying the present invention to a long line head corresponding to the full width of the recording medium, it is possible to prevent color mixing while recording images at high-speed.

Preferably, the nozzle rows are arranged independently for each of the inks of the respective colors in a shuttle type head which performs image recording while moving in a movement direction parallel to a width direction of the recording medium, the nozzle rows being aligned in a direction perpendicular to the movement direction of the shuttle type head. In this way, color mixing of the inks can be avoided in a similar fashion if the present invention is applied to a shuttle type head.

Preferably, the nozzle rows are positioned further toward an upstream side in the relative conveyance direction, the slower fixing or curing properties of the inks used in the nozzle rows. By locating nozzle rows used for ink which is slow to fix or cure in positions further to the upstream side in the relative conveyance direction, it is possible to allow a longer fixing or curing time, and therefore color mixing can be prevented more effectively.

Preferably, the image recording apparatus further comprises: a color mixing evaluation print output device which outputs a color mixing evaluation print comprising color mixing evaluation patterns including combinations of the inks of two different colors outputted at a plurality of different levels of at least one of the relative conveyance velocity and the fixing or curing energy, in such a manner that the inks of the two colors discharged from adjacent nozzle rows are mutually adjacent or partially overlapping; and a parameter setting device which sets at least one of parameters for controlling the nozzle row separation distance S, the relative conveyance velocity V and the fixing time t1 or curing time t2, according to the color mixing evaluation print outputted by the color mixing evaluation print output device.

Thereby, color mixing is evaluated by means of a color mixing evaluation print that has actually been outputted, and control parameters for avoiding color mixing can be established accordingly, thereby making it easier to avoid color mixing.

Preferably, the color mixing evaluation pattern is a resolution chart in which the inks of the two colors are outputted repeatedly and alternately in parallel band shapes which are partially overlapping with each other, a width of the band shapes gradually becoming narrower. By using a chart of this kind, the color mixing can readily be evaluated by visual inspection.

As described above, according to the image recording apparatus relating to the present invention, it is possible to prevent color mixing of inks on the surface of the recording medium, while also performing recording at high speed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 16 is an illustrative diagram showing respective parameters for implementing control in order to prevent color mixing; and FIG. 17 is an illustrative diagram showing the relationship between quality modes and weighting factors.

DETAILED DESCRIPTION OF THE PREFERRED EMBODIMENTS

In the present invention, an embodiment of the image recording apparatus is explained as example of an inkjet recording apparatus in the following.

Figure 1:
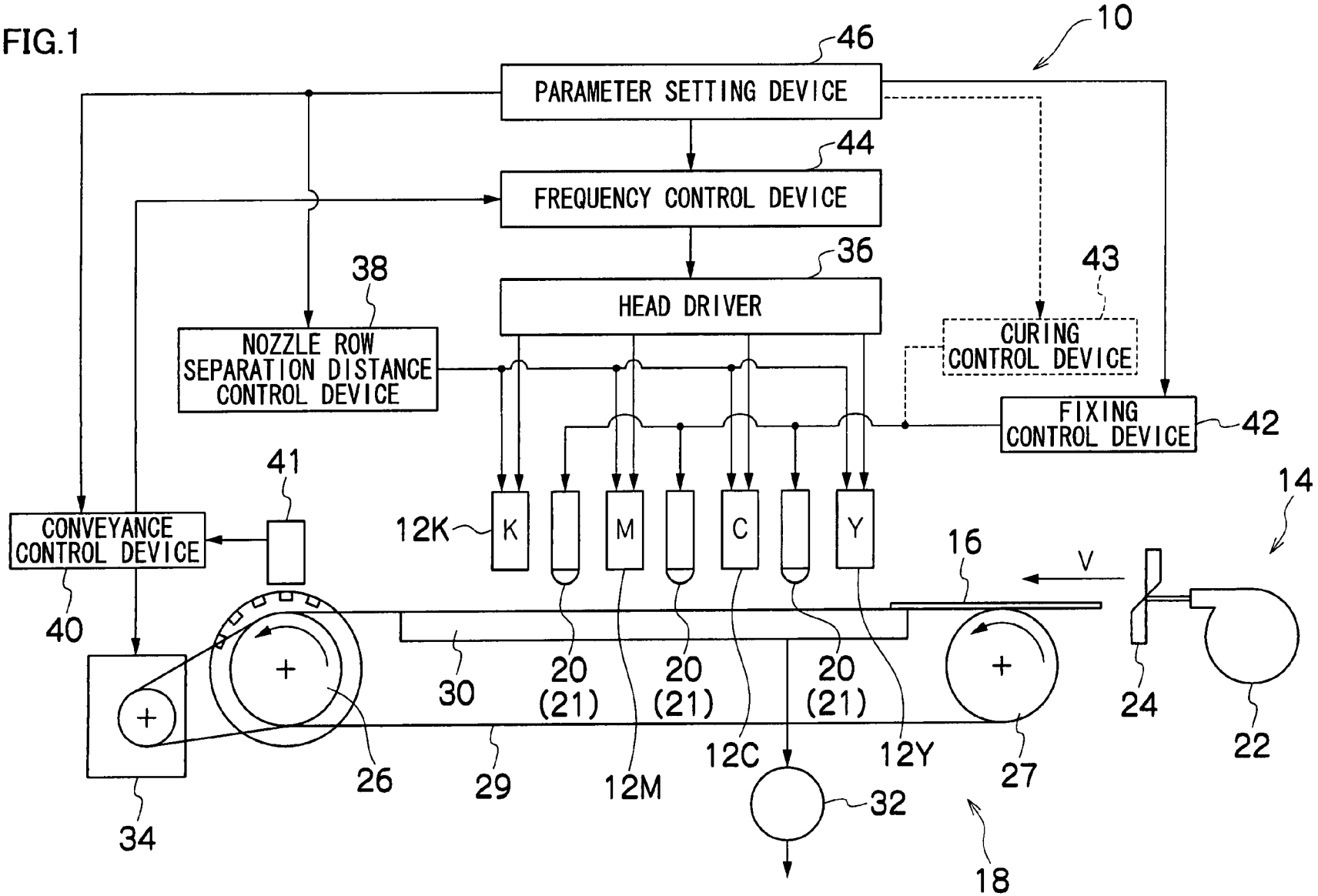
FIG. 1 is a general schematic drawing of an inkjet recording apparatus according to an embodiment of the present invention, showing at a block diagram in part.

FIG. 1 is a general schematic drawing of an inkjet recording apparatus according to an embodiment of the present invention, showing at a block diagram in part.

As shown in FIG. 1, the inkjet recording apparatus 10 comprises: a printing unit 12 having a plurality of print heads 12Y, 12C, 12M, and 12K for ink colors of yellow (Y), cyan (C), magenta (M), and black (K), respectively; a conveyance unit 18 for supplying a recording paper 16 as a recording medium from a paper supply unit 14 to the print heads 12Y, 12C, 12M, and 12K; a decurling unit 20 for removing curl in the recording paper 16; and a fixing/curing medium 20 for fixing and curing the ink deposited on the recording paper 16.

In FIG. 1, a magazine 22 for rolled paper (continuous paper) is shown as an example of the paper supply unit 14; however, a plurality of magazines with paper differences such as paper width and quality may be jointly provided. Paper may be supplied with a cassette that contains cut paper loaded in layers and that is used jointly or in lieu of a magazine 22 for rolled paper.

In the case of the configuration in which roll paper is used, a cutter 24 is provided as shown in FIG. 1, and the continuous paper is cut into a desired size by the cutter 24. When cut paper is used, the cutter 24 is not required.

The recording paper 16 delivered from the magazine 22 retains curl due to having been loaded in the magazine 22. In order to remove the curl, heat is applied to the recording paper 16 in the decurling unit (not shown) by a heating drum in the direction opposite from the curl direction in the magazine 22. The heating temperature at this time is preferably controlled so that the recording paper 16 has a curl in which the surface on which the print is to be made is slightly round outward.

The conveyance unit 18 has a configuration in which an endless belt 29 is set around rollers 26 and 27 so that the portion of the endless belt 33 facing at least the nozzle face of the print heads 12Y, 12C, 12M, and 12K forms a horizontal plane (flat plane).

The belt 29 has a width that is greater than the width of the recording paper 16, and a plurality of suction holes (not illustrated) are formed on the belt surface. As shown in FIG. 1, a suction chamber 30 is disposed in a position that faces the nozzle surface of the print heads 12Y, 12C, 12M, 12K on the interior side of the belt 29 which is set around the rollers 26 and 27. A negative pressure is generated by sucking the suction chamber 30 by means of a fan 32, thereby the recording paper 16 on the belt 29 is held by suction.

The belt 29 is driven in the counterclockwise direction in FIG. 1 by the motive force of a motor 34 being transmitted to at least one of the rollers 26 and 27 (for example, the roller 26 of the left-hand side as shown in FIG. 1), which the belt 29 is set around, and the recording paper 16 held on the belt 29 is conveyed from right to left in FIG. 1 at the (relative) conveyance velocity V.

Figure 2:
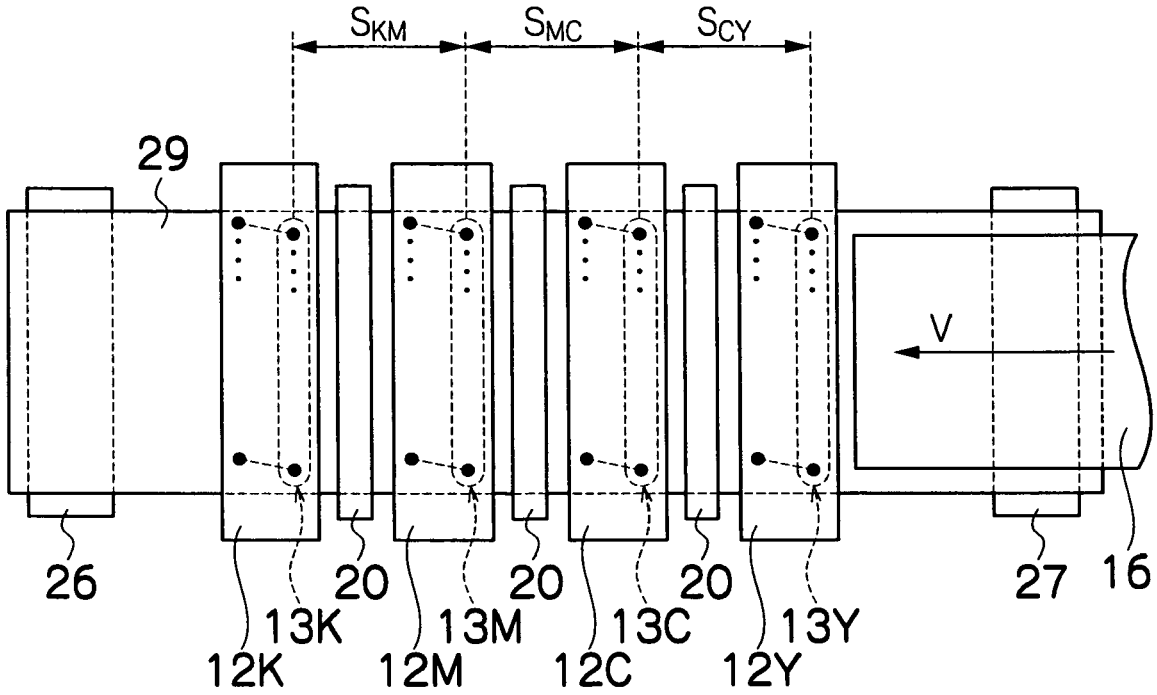
FIG. 2 is a plan view showing an enlarged view of the region of a print head in the inkjet recording apparatus shown in FIG. 1.

FIG. 2 is a plan diagram showing an enlarged view of the vicinity of print heads 12Y, 12C, 12M and 12K. As shown in FIG. 2, a plurality of nozzles 13Y, 13C, 13M, 13K, and the like, are arranged respectively for the colors (yellow (Y), cyan (C), magenta (M) and black (K)) in the print heads 12Y, 12C, 12M and 12K, and the lengthwise directions of the print heads 12Y, 12C, 12M and 12K are aligned with the breadthways direction of the paper, which is perpendicular to the conveyance direction of the recording paper 16 (the direction indicated by arrow V in the diagram), in such a manner that the print heads 12Y, 12C, 12M and 12K span the full width of the recording paper 16. In this way, full line heads having a length corresponding to the maximum paper width are obtained. Fixing and curing devices 20 having a length corresponding to the full width of the recording paper 16 are provided respectively between the print heads 12Y, 12C, 12M and 12K. The full line head may also be composed by arranging short recording heads in the breadthways direction of the paper.

The print heads 12Y, 12C, 12M, and 12K comprise a plurality of nozzle rows 13Y, 13C, 13M and 13K, respectively, in which nozzles are arranged in a two-dimensional array. The distances in the direction of conveyance of the recording paper 16 between the respective upstream side nozzle rows in the print heads 12Y, 12C, 12M, and 12K are defined as nozzle separation distances S of the print heads 12Y, 12C, 12M, and 12K. More specifically, as shown in FIG. 2, the distance between the nozzle row 13Y on the upstream side of the print head 12Y in the conveyance direction, and the nozzle row 13C on the upstream side of the print head 12C in the conveyance direction, is defined as the nozzle row separation distance $S_{CY}$, between these two colors, Y and C. Similarly, the distance between the nozzle row 13C on the upstream side of the print head 12C in the conveyance direction and the nozzle row 13M on the upstream side of the print head 12M in the conveyance direction, is defined as the nozzle row separation distance $S_{MC}$, and the distance between the nozzle row 13M on the upstream side of the print head 12M in the conveyance direction and the nozzle row 13K on the upstream side of the print head 12K in the conveyance direction is defined as the nozzle row separation distance $S_{KM}$. Since there is a possibility that dots formed on the recording paper 16 by these nozzle rows may cause color mixing on the recording paper 16, the nozzle separation distances S ($S_{CY}$, $S_{MC}$, $S_{KM}$) are controlled. These nozzle row separation distances $S_{CY}$, $S_{MC}$, and $S_{KM}$ are variable and can be controlled freely.

As shown in FIGS. 1 and 2, the print heads 12Y, 12C, 12M, and 12K are arranged in this order from the upstream side along the paper conveyance direction (from right to left in FIGS. 1 and 2). A color print can be formed on the recording paper 16 by ejecting the inks from the print heads 12Y, 12C, 12M, and 12K, respectively, onto the recording paper 16 while conveying the recording paper 16 by the conveyance unit 18.

The print heads 12Y, 12C, 12M, and 12K in which the full-line heads covering the entire width of the paper are thus provided for the respective ink colors, can record an image at high speed over the entire surface of the recording paper 16 by performing the action of moving the recording paper 16 and the print heads 12Y, 12C, 12M, and 12K relatively to each other in the sub-scanning direction just once (i.e., with a single sub-scan).

Although the configuration with the YCMK four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

Ink discharge from the print heads 12Y, 12C, 12M, and 12K is controlled by the head driver 36. The fixing and curing devices 20 provided between the print heads 12Y, 12C, 12M, and 12K serve to fix the ink discharged onto the recording paper 16 from the print heads 12Y, 12C, 12M, and 12K, and suitable devices are used in accordance with the ink discharged.

Here, "fixing" indicates a combination of permeation of the ink deposited on the recording paper 16 into the fibers of the paper, and drying of the ink from the surface, and it means that the ink deposited onto the surface of the recording paper 16 no longer exists in the form of a liquid droplet. For example, in the case of a water-based ink, the fixing and curing device 20 may be a device which applies heat energy, such as a heater, or an infrared irradiation device, or a fan (hot air fan) which blows an air flow (hot air flow) onto the paper. These devices for fixing the ink may be used independently or a plurality of these devices may be used conjointly.

In this way, it is possible to control the fixing time by applying heat energy to the ink droplets deposited onto the surface of the recording paper.

The fixing and curing devices 20 are disposed respectively between the four print heads 12Y, 12C, 12M, and 12K, as illustrated in FIGS. 1 and 2, and these fixing and curing devices 20 fix the ink discharged from the print heads, in such a manner that even when ink is subsequently discharged onto, or in the vicinity of, the fixed ink from the next print head, then the respective ink droplets do not combine and cause color mixing.

In the present embodiment, by controlling at least one of three factors, namely, the respective nozzle row separation distances of the print heads 12Y, 12C, 12M, and 12K of each color (namely, the distance $S_{CY}$ between the nozzle rows 13Y and 13C of the print heads 12Y and 12C, the distance $S_{MC}$ between the nozzle rows 13C and 13M of the print heads 12C and 12M, and the distance $S_{KM}$ between the nozzle rows 13M and 13K of the print heads 12M and 12K), and/or the (relative) conveyance velocity of the recording paper 16, and/or the fixing time through controlling the fixing energy applied to the ink by the fixing and curing devices 20, it is possible to prevent color mixing of the inks while recording images at high speed.

In the present embodiment, since the nozzle row separation distances are varied by changing the distances between the print heads if the nozzle row separation distances are actually variable, this is equivalent to saying that the nozzle row separation distances are controlled by controlling the distances between the print heads.

Furthermore, in the present embodiment, if color mixing is avoided by controlling the nozzle row separation distances (the distances between print heads), the relative conveyance velocity, and the fixing time (the fixing energy), then by setting the various control parameters to optimal values in such a manner that recording can be performed as the highest possible speed, it is possible to prevent color mixing while also achieving high-speed recording.

Therefore, in addition to the foregoing, the inkjet recording apparatus 10 according to the present embodiment comprises, as devices for controlling and avoiding color mixing: a nozzle row separation distance control device 38 which controls the nozzle row separation distances (print head separation distances); a relative conveyance velocity control device (hereafter, simply called "conveyance control device") 40 which controls the relative conveyance velocity V of the recording paper 16; a fixing control device 42 which controls the fixing time of the ink by controlling the fixing energy of the fixing and curing devices 20; a frequency control device 44 for aligning the dot pitch of the recorded image in cases where the relative conveyance velocity is varied; and a parameter setting device 46 for setting control parameters in such a manner that the respective control devices implement optimal control. Furthermore, an encoder 41 for determining the relative conveyance velocity V is provided on the roller 26, in order that the relative conveyance velocity V can be controlled by the conveyance control device 40.

The nozzle row separation distance control device 38 controls the ink discharge timing from the (nozzle rows of the) respective print heads 12Y, 12C, 12M, and 12K onto the recording paper 16, by changing the distance between adjacent print heads (namely, the nozzle separation distances S ($S_{CY}$, $S_{MC}$, $S_{KM}$)), which are the distances between the respective nozzle rows formed at the upstream side in each print head), by moving the print heads 12Y, 12C, 12M, and 12K of the respective colors in the paper conveyance direction.

For example, if it is sought to increase the color mixture prevention effect, then the nozzle row separation distances are increased in such a manner that the ink discharge from one nozzle row has dried (become fixed) to a greater extent by the time that ink is discharged from a nozzle row of the next print head. The specific device for changing the nozzle row separation distances is not limited in particular; for example, the respective print heads 12Y, 12C, 12M, and 12K may be made to move along rails provided at either end of the full line head, by means of a ball screw mechanism, or the like.

The conveyance control device 40 controls the rotational speed of the motor 34 on the basis of a determination signal from the rotary encoder 41. In this case, if an optimal value is set for the relative conveyance velocity parameter, V, as described below, then the rotation of the motor 34 is controlled in such a manner that the relative conveyance velocity of the recording paper 16 assumes the set velocity.

If the fixing and curing devices 20 apply heat, for example, then the fixing control device 42 controls the fixing time t1 by controlling the heat energy applied by changing the temperature setting of the fixing and curing devices 20, or by also changing the rotational speed of the fan blowing a hot air flow, and thus controlling the fixing energy applied to the ink on the recording paper 16.

The frequency control device 44 controls the ink discharge timing from the respective print heads 12Y, 12C, 12M, and 12K in accordance with any change in the relative conveyance velocity V of the recording paper 16, in such a manner that the recorded image is formed to the prescribed dot pitch.

An operator visually evaluates the color mixing of the inks on the basis of a color mixing evaluation print (described hereafter) outputted by the inkjet recording apparatus 10, and as a result of this evaluation, the parameter setting device 46 sets optimal parameters for the controlling at least one of the nozzle separation distance device 38, the conveyance control device 40 and the fixing control device 42.

In the inkjet recording apparatus 10 relating to the present embodiment described above, color mixing is prevented by fixing the ink discharged onto the recording paper 16 by controlling the fixing and curing devices 20 by means of the fixing control device 42. However, it is also possible to use an ultraviolet (UV) curable ink which is hardened by a polymerization reaction when UV light is irradiated onto the ink, or an ink that is curable by irradiation of an electron beam, in which case curing devices 21 such as irradiation devices for irradiating the appropriate radiation onto the ink are provided instead of the fixing and curing devices 20, color mixing of the inks being prevented by controlling the curing devices 21 by means of the curing control device 43 in such a manner that the ink is cured.

Here, "curing" means that the ink is solidified by a chemical reaction due to the irradiation of radiation or the application of heat to the ink droplets deposited on the recording paper 16, in such a manner that the ink hardens and becomes fixed to the surface of the recording paper 16. If UV-curable ink is used, then the curing device 21 may be a UV irradiation device, a halogen lamp, or a laser light emitting diode, for instance. Furthermore, if a solid ink is used, then a cooling device such as a Peltier element or a water-cooling device, may be used.

Below, as shown in FIG. 1, where the fixing control device 42 and the fixing and curing devices 20 are described, it is also possible to use a curing control device 43 and curing devices 21 instead of these, in which case, the control procedure is exactly the same. More specifically, the curing control device 43 may control the curing time t2 by, for example, controlling the curing energy applied to the ink on the recording paper 16 by changing the intensity of light irradiated by the curing devices 21, or the range of light irradiation.

Figure 3:
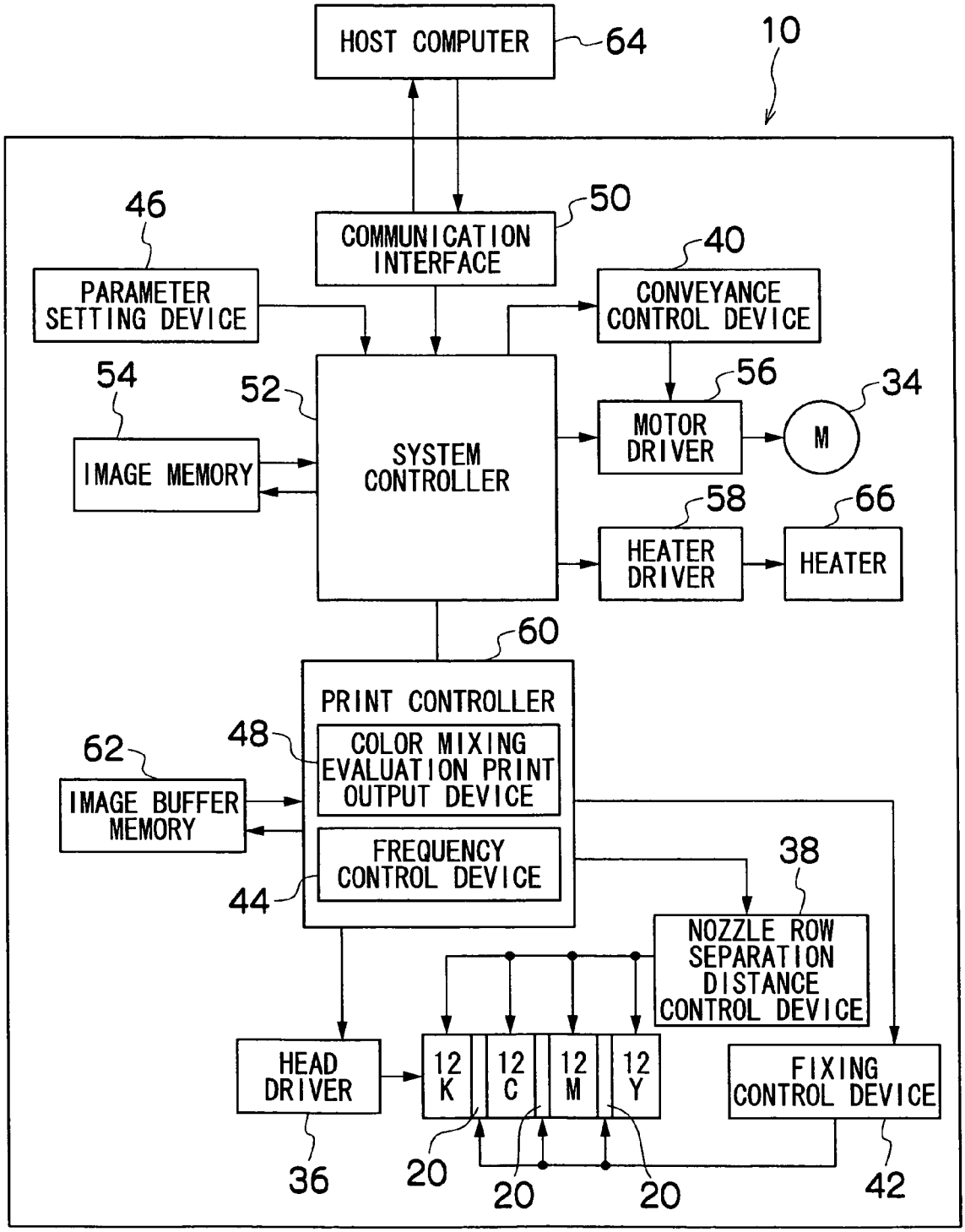
FIG. 3 is a block diagram showing the system composition of an inkjet recording apparatus according to the present embodiment.

FIG. 3 is a block diagram of the principal components showing the system configuration of the inkjet recording apparatus 10. The inkjet recording apparatus 10 has a communication interface 50, a system controller 52, an image memory 54, a motor driver 56, a heater driver 58, a print controller 60, an image buffer memory 62, a head driver 36, and other components.

The communication interface 50 is an interface unit for receiving image data sent from a host computer 64. A serial interface such as USB, IEEE1394, Ethernet, wireless network, or a parallel interface such as a Centronics interface may be used as the communication interface 50. A buffer memory (not shown) may be mounted in this portion in order to increase the communication speed. The image data sent from the host computer 64 is received by the inkjet recording apparatus 10 through the communication interface 50, and is temporarily stored in the image memory 54. The image memory 54 is a storage device for temporarily storing images inputted through the communication interface 50. The image memory 54 is not limited to memory composed of a semiconductor element, and a hard disk drive or another magnetic medium may be used.

The system controller 52 controls the communication interface 50, image memory 54, motor driver 56, heater driver 58, and other components. The system controller 52 has a central processing unit (CPU), peripheral circuits therefore, and the like. The system controller 52 controls communication between itself and the host computer 64, controls reading and writing from and to the image memory 54, and performs other functions, and also generates control signals for controlling a heater 66 and the motor 34 in the conveyance system.

The motor driver (drive circuit) 56 drives the motor 34 in accordance with commands from the system controller 52. The heater driver (drive circuit) 58 drives the heater 66 of the post-drying unit (not shown) or the like in accordance with commands from the system controller 52.

The print control unit 60 is a control unit having a signal processing function for performing various treatment processes, corrections, and the like, in accordance with the control implemented by the system controller 52, in order to generate a signal for controlling printing, from the image data in the image memory 54, and it supplies the print control signal (image data) thus generated to the head driver 36. Prescribed signal processing is carried out in the print control unit 60, and the discharge amount and the discharge timing of the ink droplets from the respective print heads 12Y, 12C, 12M, and 12K are controlled via the head drier 36, on the basis of the image data. By this means, prescribed dot size and dot positions can be achieved.

The print control unit 60 is provided with the image buffer memory 62; and image data, parameters, and other data are temporarily stored in the image buffer memory 62 when image data is processed in the print control unit 60. The aspect shown in FIG. 3 is one in which the image buffer memory 62 accompanies the print control unit 60; however, the image memory 54 may also serve as the image buffer memory 62. Also possible is an aspect in which the print control unit 60 and the system controller 52 are integrated to form a single processor.

The head driver 36 drives actuators for the print heads 12Y, 12C, 12M and 12K of the respective colors on the basis of the print data received from the print control unit 60. A feedback control system for keeping the drive conditions for the print heads constant may be included in the head driver 36.

Furthermore, the inkjet recording apparatus 10 according to the present embodiment also comprises, in addition to the foregoing, a nozzle row separation distance control device 38 for controlling the nozzle row separation distances, $S_{CY}$, $S_{MC}$, $S_{KM}$, between the adjacent print heads (in the present embodiment, this corresponds to the print heads 12Y and 12C, the print heads 12C and 12M, and the print heads 12M and 12K, as shown in FIG. 1 and FIG. 2); a conveyance control device 40 for controlling the relative conveyance velocity V of the recording paper 16; a fixing control device 42 for controlling the fixing time t1 of the ink discharged onto the recording paper 16 by controlling the fixing energy of the fixing and curing devices 20; a frequency control device 44 for controlling the ink discharge frequency in accordance with any change in the relative conveyance velocity V; a parameter setting device 46 for setting parameters for controlling the respective control devices; a color mixing evaluation print output device 48 for forming a color mixing evaluation pattern in order to output a print for evaluating color mixing as described in detail below, and outputting a print for evaluating color mixing from the print heads 12Y, 12C, 12M, and 12K, by means of the head driver 36; and the like.

Here, the frequency control device 44 and the color mixing evaluation print output device 48 are provided inside the print control unit 60 and are controlled by the system controller 52.

Next, a method for setting optimal parameters for the control devices in order to prevent color mixing and achieve high-speed recording will be described. Firstly, the process of creating a color mixing evaluation pattern in order to evaluate color mixing is described.

This color mixing evaluation pattern is used by an operator to visually evaluate color mixing, and it is formed by recording lines of two colors of ink at different values of the relative conveyance velocity V and the fixing energy E, in order to determine the degree of intermixing between the two colors of ink (yellow (Y) and cyan (C), cyan (C) and magenta (M), magenta (M) and black (K)) discharged from the nozzle rows of two print heads 12Y and 12C, 12C and 12M, and 12M and 12K, which are positioned adjacently in the inkjet recording apparatus 10, as shown in FIG. 1 or FIG. 2.

Figure 4:
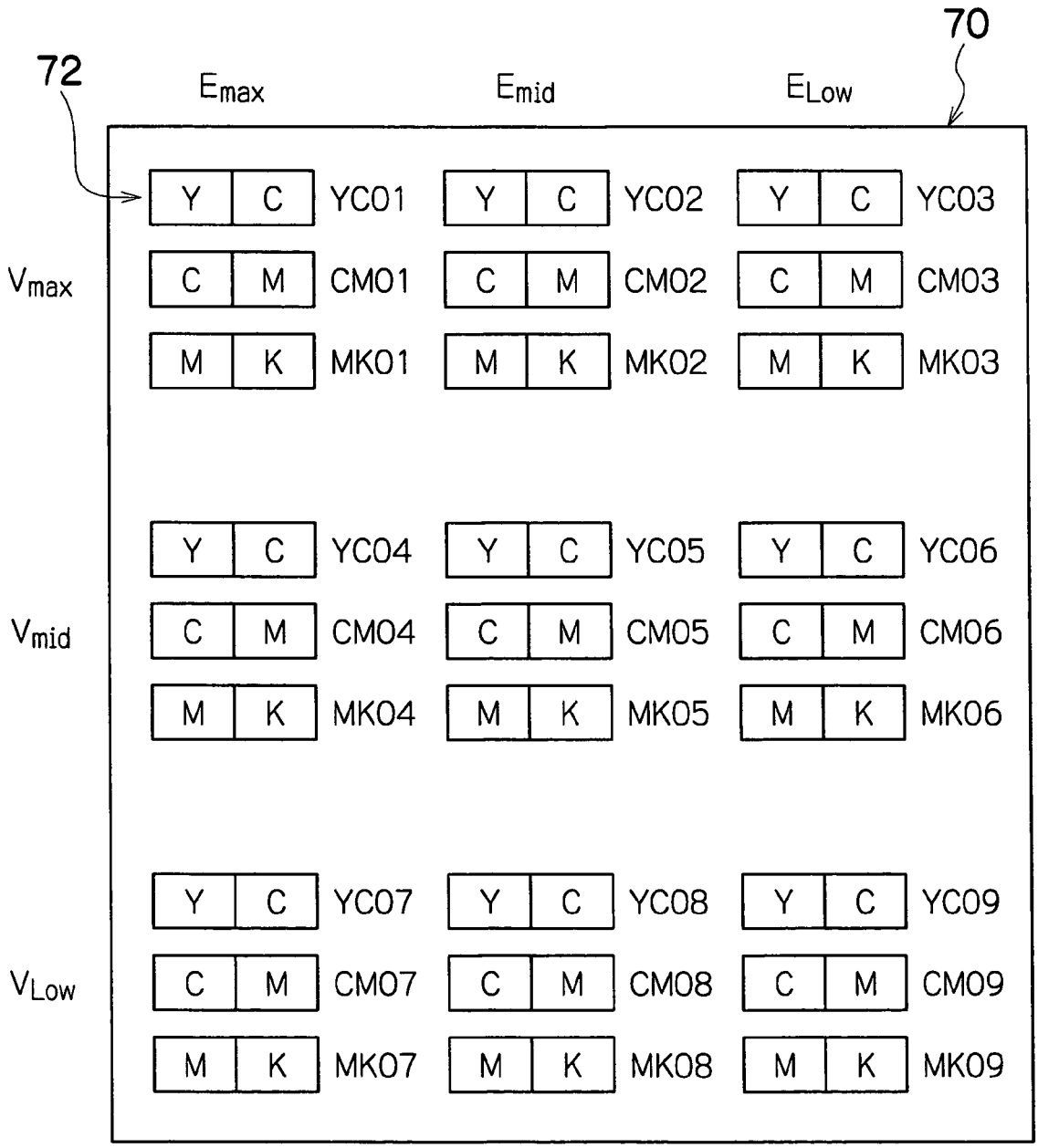
FIG. 4 is an illustrative diagram showing an example of a color mixing evaluation pattern used in the present embodiment.

FIG. 4 shows an example of a pattern used for visual evaluation of color mixing. As shown in FIG. 4, the color mixing evaluation pattern 70 is formed by recording at three different level settings, max, mid and low, of the relative conveyance velocity V and the fixing energy E. Therefore, for each combination of two adjacent ink colors, nine patches 72 including color mixing evaluation patterns are formed. Here, of the three levels for the conveyance velocity V and the fixing (curing) energy E, "max" indicates maximum velocity (or maximum energy), "mid" indicates a value at approximately /2;3 of the maximum, and "low" indicates a value at approximately ⅓ of the maximum.

Furthermore, as shown in FIG. 4, each of the nine patches 72 corresponding to the respective combinations of two colors are labeled with a number (reference numeral), namely, YC01 to YC09, CM01 to CM09, and MK01 to MK09, so that they can be used when setting the parameters.

Figure 5:
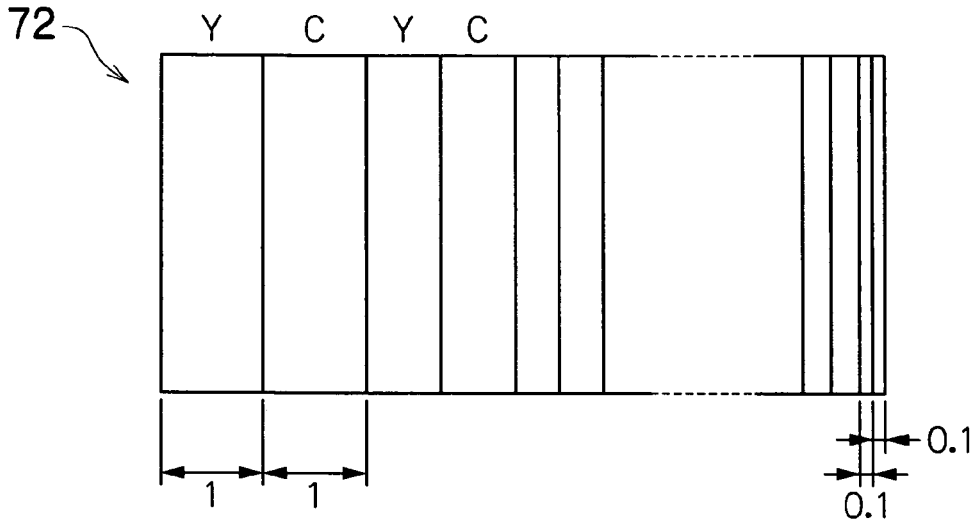
FIG. 5 is an illustrative diagram showing one patch of the color mixing evaluation pattern in FIG. 4.

As shown in FIG. 5, the patches 72 of the respective color mixing patterns including resolution charts in which the two colors (in this case, Y and C) are printed alternately in band shapes (rectangular shapes) which gradually decrease in width, from the left-hand side to the right-hand side. In particular, at the boundary regions between the two colors, a number of dots (1 to 2 dots) are printed in an adjacent or overlapping fashion in order to evaluate color mixing. Furthermore, as shown in FIG. 5, the width of the respective band-shaped regions of Y and C is initially 1 mm each, for example, and the width gradually decreases and finally reaches a value of 0.1 mm each.

Figure 6A:
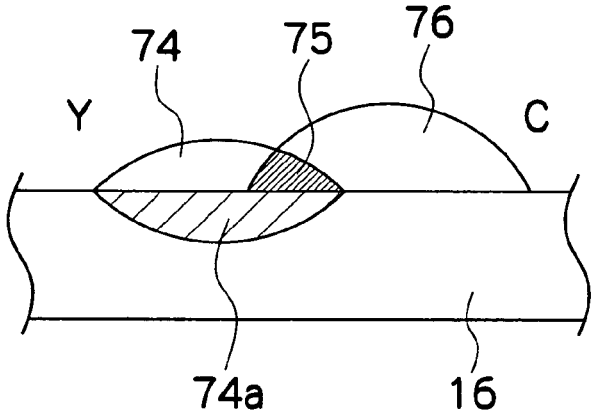
FIGS. 6A and 6B are cross-sectional diagrams showing the aspect of color mixing between two inks on the recording medium.
Figure 6B:
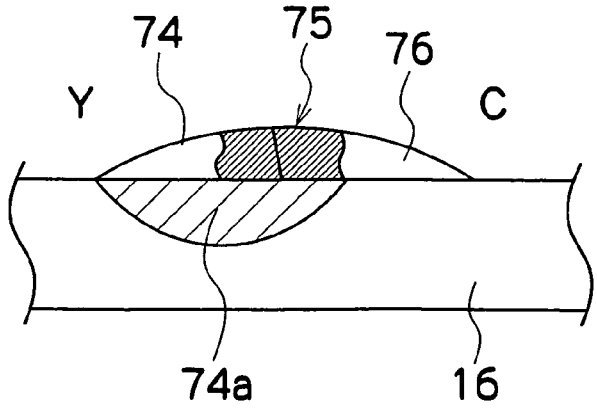

Furthermore, FIGS. 6A and 6B show a situation where inks of two colors mix at the boundary regions. As shown in FIG. 6A, Y ink 74 is discharged onto the recording paper 16, and C ink 76 is discharged at a slight positional displacement from the Y ink, so that it is partially overlapping. The Y ink 74 gradually permeates into the recording paper 16, as indicated by the reference numeral 74*a*, and it proceeds to dry on the surface of the recording paper 16.

In this case, if C ink 76 is discharged before the Y ink 74 has become fixed, then color mixing (bleeding) will occur in the overlapping portion 75. Thereupon, as shown in FIG. 6B, the inks will become fixed in a state where the two colors are combined (or have bled together) in the overlapping portion 75.

The color mixing evaluation print output device 48 generates data for a color mixing evaluation pattern 70 as illustrated in FIG. 4 and FIG. 5, or alternatively, data for a color mixing evaluation pattern 70 is called up from a prescribed memory and supplied to the print heads 12Y, 12C, 12M, and 12K via the head driver 36, and the data is outputted as a color mixing evaluation print.

In this way, color mixing is visually evaluated by using color mixing evaluation patterns outputted as a color mixing evaluation print, and for each combination of two colors, the patch of highest resolution showing least color mixing is extracted and the number of that patch is input to the parameter setting device 46. In this way, it is possible to set optimal parameters for the conveyance velocity (recording velocity) V and the fixing energy E, in accordance with the combination of recording paper 16 and ink used.

Therefore, by selecting the combination of the fixing energy E and the conveyance velocity V which achieves the highest resolution with least color mixing, it is possible to satisfy the relationship, S/V>t1, with respect to the nozzle row separation distance S corresponding to the combination of colors ($S_{CY}$, $S_{MC}$ or $S_{KM}$) and the fixing time t1 corresponding to the fixing energy E. By setting the control parameters to these values, it is possible to avoid color mixing during image recording.

FIG. 4 shows an embodiment in which the parameter in the vertical direction of the patch pattern is a changing conveyance velocity V relating to a uniform nozzle separation distance S for the respective color combinations, but is also possible to use a patch pattern in which the parameter in the vertical direction is a changing nozzle separation distance relating to a uniform conveyance velocity for the respective color combinations.

The parameter setting device 46 may be a device which stores the recording medium type, an ID No. indicating the ink type, or setting parameters.

Below, the action of the present embodiment is described with reference to FIG. 7.

Figure 7:
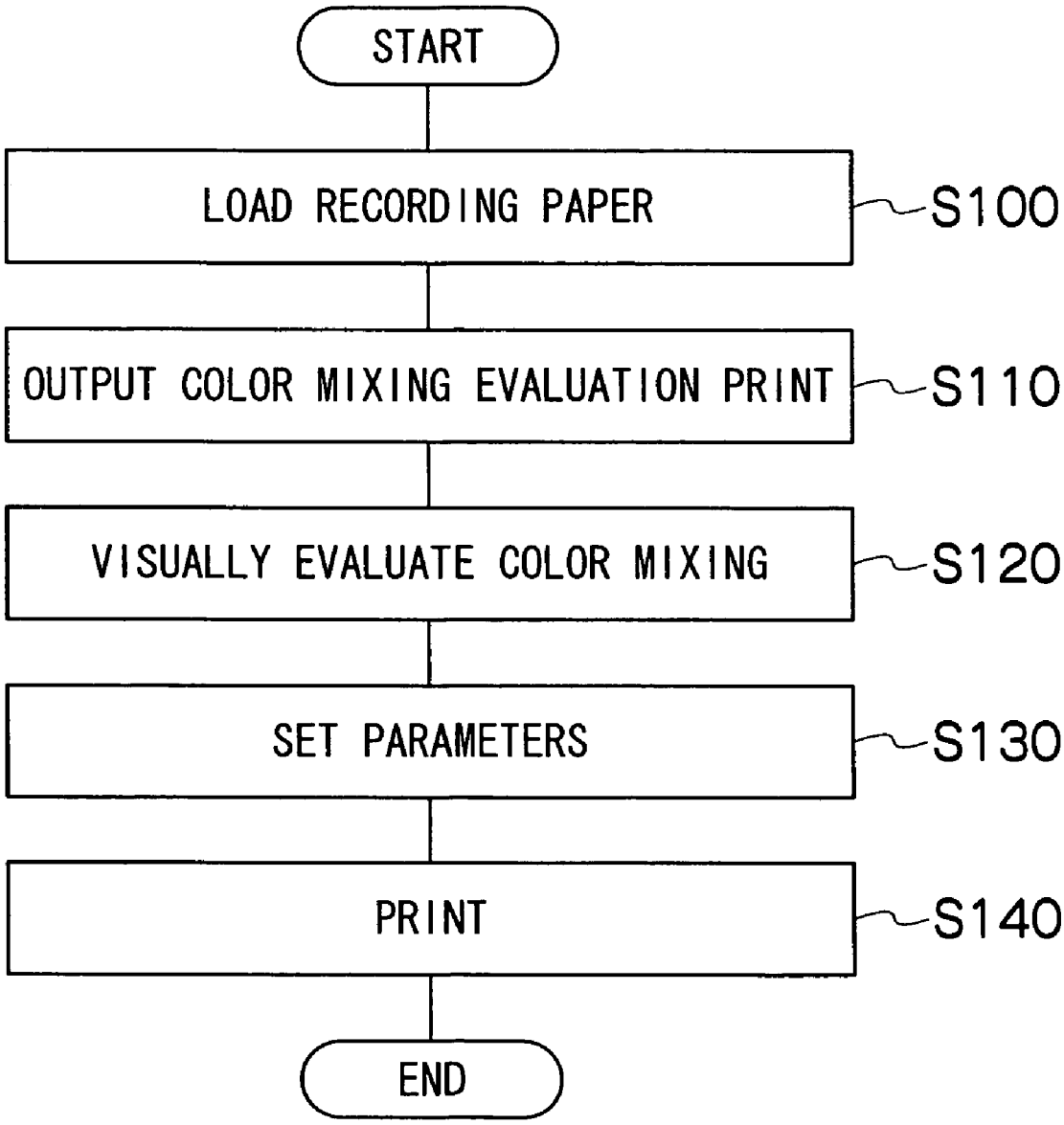
FIG. 7 is a flowchart illustrating the action of the first embodiment.

Firstly, at step S100 in FIG. 7, a magazine 22 for supplying recording paper 16 is loaded into the inkjet recording apparatus 10. At the next step, S110, a color mixing evaluation print is outputted. The color mixing evaluation print is outputted from the print heads 12Y, 12C, 12M, and 12K, via the head driver 36, by means of the color mixing evaluation print output device 48 creating data for a color mixing evaluation pattern 70 as illustrated in FIG. 4.

Next, at step S120, the operator visually evaluates the color mixing of the respective inks, by means of the outputted color mixing evaluation print. For each combination of two colors, the operator chooses a patch corresponding to the combination of conveyance velocity V and fixing energy E which produces least color mixing at the highest resolution.

In the next step, S130, the operator selects the patch number of the chosen patch as shown in FIG. 4, and inputs that number via the parameter setting device 46. The parameter setting device 46 stores the control parameters, namely, the respective nozzle row separation distances S, the relative conveyance velocity V, and the fixing time t1 (fixing energy) corresponding to each patch number, and it sets the respective control parameters corresponding to the input number in the respective control devices. At step S140, printing is performed using the established control parameters.

Furthermore, if the patch numbers YC01, CM04, MK07 are selected, then since it is not possible to set different conveyance velocities for each color combination, the parameters can be set using the relationship S>V×t1, derived from the inequality, S/V>t1, in order to set the nozzle separation distance for the respective color combinations to $S_{CY}$>Vmax×t1 for YC01, $S_{MC}$>Vmid×t1 for CM04, and $S_{KM}$>Vmax×t1 for MK07.

In this way, in the present embodiment, the operator visually evaluates color mixing by using a color mixing evaluation pattern based on a resolution chart as illustrated in FIG. 5. Therefore, control parameters can be set which make it possible reliably to prevent color mixing, and once color mixing has been evaluated and the parameters have been set, then image recording can subsequently be carried out at high-speed, while avoiding the occurrence of color mixing by means of the established parameters.

Furthermore, in the present embodiment, the print heads 12Y, 12C, 12M, and 12K are arranged as shown in FIG. 1 or FIG. 2, but the slower the permeation and drying of the ink and the longer the fixing time of the ink used in a particular head, or the greater the amount of curing energy required for the ink used in a particular head, the further toward the upstream side in the conveyance direction that head should be positioned. By positioning the print heads 12Y, 12C, 12M, and 12K in this way, it is possible to achieve a uniform drying or curing state of the ink discharged from any one of the print heads 12Y, 12C, 12M, and 12K onto the recording paper 16, when it arrives at the next print head 12Y, 12C, 12M, and 12K (on the downstream side). Therefore, color mixing can be prevented effectively.

As stated above, if the curing control device 43 controls the curing time t2 by regulating the curing energy applied by the curing devices 21, then it is possible to control at least one of the curing energy E, conveyance velocity V and nozzle row separation distance S, in such a manner that S/V>t2, so that color mixing is avoided.

Next, a second embodiment of the present invention will be described.

Figure 8:
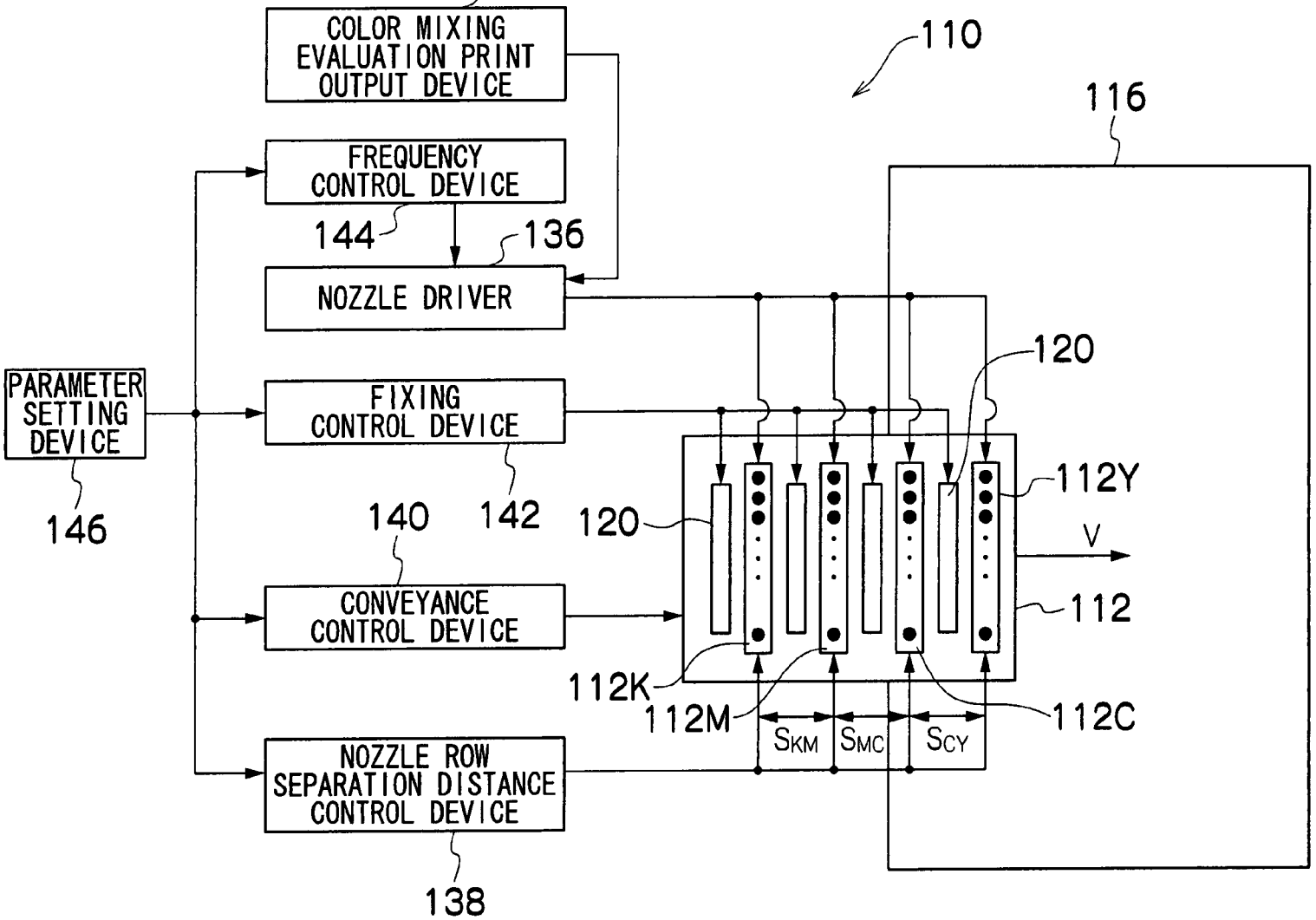
FIG. 8 is a block diagram including a partial plan view of the composition of an inkjet recording apparatus relating to a second embodiment of the present invention.

FIG. 8 is a block diagram showing a control device relating to color mixing prevention control, including a plan diagram showing an enlarged view of the region of the print head in an inkjet recording apparatus 110 relating to a second embodiment of the present invention.

As shown in FIG. 8, the print head 112 according to the second embodiment is a shuttle type head for recording images while moving reciprocally back and forth in the breadthways direction of the recording paper 116. In this case, the print head 112 performs image recording only when moving in one direction from one end toward the other end in the breadthways direction of the recording paper 116, and the print head 112 does not perform image recording when it reaches the far end and moves back to the first end.

In the print head 112, the nozzle rows 112Y, 112C, 112M and 112K discharging the inks of the respective colors, yellow (Y), cyan (C), magenta (M) and black (K), are arranged in parallel with a direction substantially perpendicular to the conveyance direction of the print head 112 (the breadthways direction of the recording paper 116). The nozzle rows 112Y, 112C, 112M and 112K of the respective colors are arranged in such a manner that the nozzle row separation distances S between adjacent nozzle rows can be varied in sequence from the upstream side of the direction in which the print head 112 moves during recording (namely, the nozzle row separation distance $S_{CY}$ between the nozzle row 112Y and nozzle row 112C, the nozzle row separation distance $S_{MC}$ between the nozzle row 112C and the nozzle row 112M, and the nozzle row separation distance $S_{KM}$ between the nozzle row 112M and the nozzle row 112K).

Fixing and curing devices 120 are arranged in parallel with the nozzle rows 112Y, 112C, 112M and 112K, respectively on the downstream side thereof.

Moreover, the recording paper 116 remains stationary when the print head 112 is moved from one end toward the other end in the breadthways direction of the recording paper 116 while recording onto the paper. When the print head 112 has finished printing from one end to the other end in the breadthways direction of the recording paper 116 and has been moved back to the first end of the paper, then the recording paper 116 is conveyed in the direction perpendicular to the breadthways direction of the recording paper 116 by an amount corresponding to the width of the band-shaped region in the breadthways direction of the recording paper 116 that has just been recorded by the print head 112 (in other words, the width of the nozzle row 112Y, etc.)

In the present embodiment, since the print head 112 is a shuttle type head, then in contrast to the first embodiment described above, the recording paper 116 is halted during image recording and only the print head 112 is moved. The direction of movement of the print head 112 corresponds to the relative conveyance direction (between the recording paper 16 and the print head 12) in the first embodiment described above.

Furthermore, as shown in FIG. 8, similarly to the first embodiment, the inkjet recording apparatus 110 according to the present embodiment comprises, as control devices for preventing color mixing, a nozzle row separation distance control device 138, a nozzle driver 136 (corresponding to the head driver 36 in the first embodiment), a conveyance control device 140, a fixing control device 142, a frequency control device 144, a parameter setting device 146, a color mixing evaluation print output device 148, and the like. The nozzle driver 136 controls ink discharge in the respective nozzle rows and it corresponds to the head driver 36 in the first embodiment.

In the present embodiment, the nozzle row separation distance control device 138 is able to vary the actual distances between the nozzle rows 112Y, 112C, 112M and 112K (in other words, the distance $S_{CY}$ between the nozzle rows 112Y and 112C, the distance $S_{MC}$ between the nozzle rows 112C and 112M, and the distance $S_{KM}$ between the nozzle rows 112M and 112K).

Furthermore, the conveyance control device 140 controls the movement velocity V of the print head 112 during recording, as the relative conveyance velocity.

It should be noted that the fixing control device 142, the frequency control device 144, the parameter setting device 146 and the color mixing evaluation print output device 148 all operate in the same fashion as the first embodiment described above, and hence detailed description thereof is omitted here.

Consequently, the present embodiment differs from the first embodiment in that a shuttle head is used instead of a full line head, and therefore nozzle rows for all four colors are disposed in a single shuttle head, rather than providing nozzle rows for each color in separate line heads as in the first embodiment. However, the fact that the distance between nozzle rows can be changed, and the relationship between the print head (nozzle rows), the recording medium, and the relative conveyance direction, are all the same as in the first embodiment.

Consequently, in the present embodiment, control for avoiding color mixing can be achieved similarly to the first embodiment, and hence the action of the present embodiment is basically the same as that of the first embodiment. A simple description of the action of the present embodiment is given below.

The color mixing evaluation print output device 148 creates a color mixing evaluation pattern such as that shown in FIG. 4 or FIG. 5, and it supplies this data to the print head 112 via the nozzle driver 136, thereby outputting a color mixing evaluation print. The outputted color mixing evaluation print is evaluated visually by an operator, who selects the patch corresponding to the combination of relative conveyance velocity V and fixing energy E that achieves minimum color mixing at highest resolution, for each of the color combinations. The operator inputs the patch numbers via the parameter setting device 146.

The parameter setting device 146 sets the control devices with the control parameters corresponding to the input patch numbers. In this way, a preset value is established for at least one of the relative conveyance velocity V of the print head 112 (the movement velocity in the breadthways direction of the recording paper 116), the respective nozzle row separation distances $S_{CY}$, $S_{MC}$, $S_{KM}$, and the fixing energy E of the fixing and curing device 120. When optimal control parameters for avoiding color mixing have been established in this way, printing is carried out by driving the shuttle type print head 112.

Next, a third embodiment of the present invention will be described.

Figure 9:
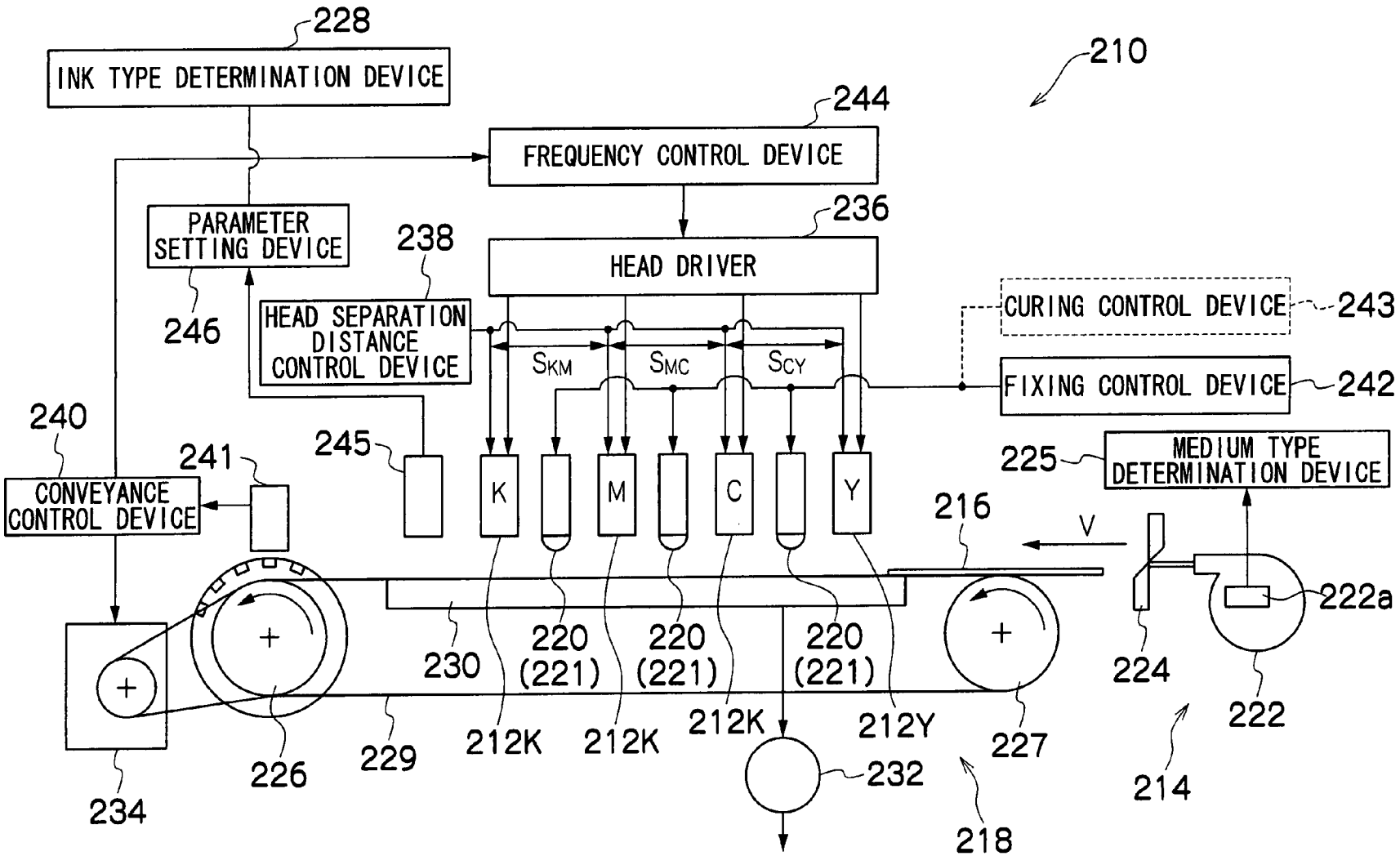
FIG. 9 is a general schematic drawing including a partial block diagram of the composition of an inkjet recording apparatus relating to a third embodiment of the present invention.

FIG. 9 is a general schematic drawing including a partial block diagram of the composition of an inkjet recording apparatus relating to a third embodiment of the present invention.

As shown in FIG. 9, the inkjet recording apparatus 210 is principally constituted by a plurality of print heads 212Y, 212C, 212M and 212K provided respectively for the ink colors yellow (Y), cyan (C), magenta (M) and black (K), a conveyance unit 218 for conveying recording paper 216 forming a recording medium from a paper supply unit 214 to the print heads 212Y etc., and fixing and curing devices 220 for fixing ink that has been discharged onto the recording paper 216.

As shown in FIG. 9, the recording paper 216 is used by cutting rolled paper (continuous paper) loaded in a magazine 222 into prescribed lengths by means of a cutter 224, but it is also possible to use a plurality of magazines carrying paper of different widths and qualities, jointly. Moreover, papers may be supplied in cassettes that contain cut papers loaded in layers and that are used jointly or in lieu of magazines for rolled papers.

In the case of a configuration in which roll paper is used, a cutter 224 is provided as shown in FIG. 9, and the roll paper is cut to a desired size by the cutter 224. When cut paper is used, the cutter 224 is not required.

Furthermore, in the present embodiment, an information recording body, such as a bar code or wireless tag, recording paper type information is attached to a medium type determination notch 222*a* of the magazine 222, and a medium type determination device 225 for reading in the information on the information recording body is provided. As described hereinafter, optimal control parameters are set for image recording onto the recording medium, on the basis of the information read in by the medium type determination device 225.

The recording paper 216 delivered from the magazine 222 retains curl due to having been loaded in the magazine 222. In order to remove the curl, heat is applied to the recording paper 216 in a decurling unit (not shown) by a heating drum in the direction opposite to the curl direction in the magazine. The heating temperature at this time is preferably controlled so that the recording paper 216 retains a slight outward curl of the print surface of the paper.

The conveyance unit 218 has a configuration in which an endless belt 229 is set around rollers 226 and 227 so that the portion of the endless belt 33 facing at least the nozzle face of the printing head 212K, and so on forms a horizontal plane (flat plane).

The belt 229 has a width that is greater than the width of the recording paper 216, and a plurality of suction holes (not illustrated) are formed on the belt surface. A suction chamber 230 is disposed in a position facing the nozzle surface of the print heads 212Y, 212C, 212M and 212K on the interior side of the belt 229 which is set around the rollers 226 and 227, as shown in FIG. 9. The suction chamber 230 provides suction by means of a fan 232 to generate a negative pressure, thereby holding the recording paper 216 on the belt 229 by suction.

The belt 229 is driven in the counterclockwise direction in FIG. 9 by the motive force of a motor 234 being transmitted to at least one of the rollers 226 and 227 (for example, the left-hand roller 226 shown in FIG. 9) about which the belt 229 is set, and the recording paper 216 held on the belt 229 is conveyed from right to left in FIG. 9 at the (relative) conveyance velocity V.

The print heads 212Y, 212C, 212M and 212K each have a plurality of nozzles corresponding to the respective colors (Y, C, M and K), and the lengthwise direction of the print heads 212Y, 212C, 212M and 212K are aligned with the breadthways direction of the recording paper 216, which is perpendicular to the conveyance direction of the recording paper 216, in such a manner that they span the full width of the recording paper 16. In this way, full line heads having a length corresponding to the maximum paper width are obtained. Furthermore, the distance between the print heads 212Y and 212C is $S_{CY}$, the distance between the print heads 212C and 212M is $S_{MC}$, and the distance between the print heads 212M and 212K is $S_{KM}$. In this way, the print heads 212Y, 212C, 212M and 212K of the respective colors are line heads in which a plurality of nozzles are arranged through a length exceeding at least one edge of the maximum-size recording paper 216 compatible with the inkjet recording apparatus 210.

The print heads 212Y, 212C, 212M, and 212K corresponding to respective ink colors are disposed in the order, yellow (Y), cyan (C), magenta (M) and black (K), from the upstream side, following the direction of conveyance of the recording paper 216 (the right to leftward direction in the drawing). A color image can be formed on the recording paper 216 by discharging colored inks respectively from the print heads 212Y, 212C, 212M and 212K, while conveying the recording paper 216 by means of the conveyance unit 218.

Furthermore, an ink type determination device 228 for determining the ink type is provided in the vicinity of an ink tank (not illustrated) which supplies inks of various colors to the respective print heads 212Y, 212C, 212M and 212K. The ink type determination device 228 is not limited in particular, and in the case of a cartridge type ink tank, for example, it may be composed so as to read in an ID indicating the ink type from an information recording body, or the like, attached to the cartridge.

The fixing and curing devices 220 fix the ink discharged from the print heads 212Y, 212C, 212M and 212K onto the recording paper 216, and a suitable device is used according to the type of ink.

The fixing and curing devices 20 are disposed respectively between the four print heads 212Y, 212C, 212M and 212K, as illustrated in FIG. 9, and they dry and fix the ink discharged from the print heads in such a manner that there is no color mixing of the inks, even when ink is discharged from the next print head in the vicinity of previously discharged ink.

In the present embodiment, by controlling at least one of three factors, namely, the separation distances between the print heads 212Y, 212C, 212M, and 212K of each color (namely, the distance $S_{CY}$ between the print heads 212Y and 212C, the distance $S_{MC}$ between the print heads 212C and 212M, and the distance $S_{KM}$ between the print heads 212M and 212K), and/or the (relative) conveyance velocity of the recording paper 216, and/or the fixing time through controlling the drying (fixing) energy applied to the ink by the fixing and curing devices 220, it is possible to prevent color mixing of the inks while recording images at high speed.

Furthermore, in this case, if color mixing is avoided by controlling the print head separation distances, the relative conveyance velocity, and the fixing time (the fixing energy), then by setting the various control parameters to optimal values in such a manner that recording can be performed as the highest possible speed, it is possible to prevent color mixing while also achieving high-speed recording.

Therefore, the inkjet recording apparatus 210 according to the present embodiment also comprises, in addition to the foregoing, a head separation distance control device 238 for controlling the separation distances between nozzle rows by controlling the distances between the print heads; a conveyance control device 240 for controlling the relative conveyance velocity V of the recording paper 216; and a fixing control device 242 for controlling the fixing time of the ink by controlling the fixing energy of the fixing and curing devices 220. Similarly to the first embodiment, it is also possible to provide curing devices 221 and a curing control device 243 instead of the fixing and curing devices 220 and the fixing control device 242. In this case, the curing time t2 is controlled by controlling the curing energy.

Furthermore, an encoder 241 for determining the relative conveyance velocity V is provided on the roller 226, in order that the relative conveyance velocity V can be controlled. Moreover, if the relative conveyance velocity V is to be controlled, then the inkjet recording apparatus 210 also comprises a frequency control device 244 which controls the discharge frequency of the print heads 212Y and so on, in such a manner that the prescribed dot pitch is obtained in the recorded image.

Furthermore, in order to achieve the object of preventing color mixing while allowing high-speed image recording, the inkjet recording apparatus 210 according to the present embodiment comprises a densitometer 245 for measuring a color mixing evaluation pattern used to set the control parameters to optimal values, and a parameter setting device 246 which calculates optimal parameters on the basis of the measurement results obtained by the densitometer 245.

The head separation distance control device 238 controls the ink discharge timings from the print heads 212Y, 212C, 212M and 212K onto the recording paper 216 by altering the distances between the print heads (for example, the distance $S_{CY}$ between the print heads 212Y and 212C) by moving the print heads 212Y, 212C, 212M and 212K in the relative conveyance direction. For example, if it is sought to increase the color mixing prevention effect, then the distance between the print heads is increased, thereby allowing the ink to dry to a greater extent. The specific device for changing the print head separation distances is not limited in particular; for example, the respective print heads 212Y, 212C, 212M and 212K may be made to move along rails provided at either end of the full line head, by means of a ball screw mechanism, or the like.

The conveyance control device 240 controls the rotational speed of the motor 234 on the basis of a determination signal from the rotary encoder 241. In this case, if an optimal value is set for the relative conveyance velocity parameter, V, then the rotation of the motor 234 is controlled in such a manner that the relative conveyance velocity of the recording paper 216 assumes the set velocity.

Similarly to the first embodiment, the fixing control device 242 controls the fixing time by controlling the fixing energy applied to the ink on the recording paper 216. This involves either controlling the heat energy applied by the fixing and curing devices 220 by altering the temperature settings thereof, or changing the rotational speed of the fan blowing a hot air flow.

Furthermore, the frequency control device 244 controls the ink discharge timing from the respective print heads 212Y, and so on, in accordance with any change in the relative conveyance velocity of the recording paper 216, in such a manner that the prescribed dot pitch is obtained in the recorded image.

In order to set optimal parameters for preventing color mixing while recording images at high speed, firstly, a color mixing evaluation pattern is created.

This color mixing evaluation pattern is formed by recording two colors of ink at different values of the relative conveyance velocity V and the fixing energy E, in order to determine the degree of intermixing between the two colors of ink (yellow (Y) and cyan (C), cyan (C) and magenta (M), magenta (M) and black (K)) discharged from two print heads 212Y and 212C, 212C and 212M, and 212M and 212K, which are positioned adjacently in the inkjet recording apparatus 210, as shown in FIG. 9.

Figure 10:
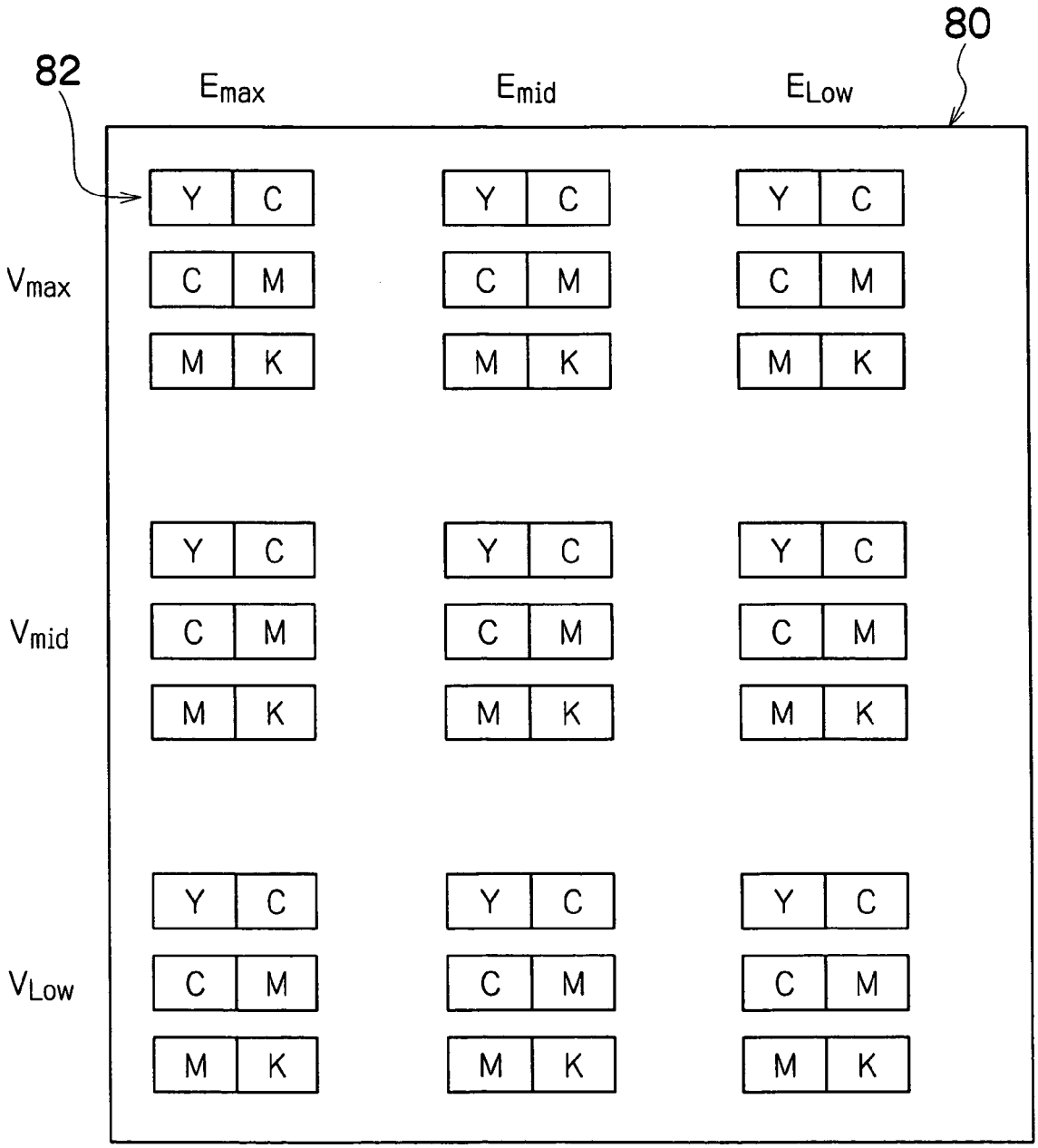
FIG. 10 is an illustrative diagram showing an example of a color mixing evaluation pattern used in the third embodiment.

FIG. 10 shows an example of a color mixing evaluation pattern. As shown in FIG. 10, the color mixing evaluation pattern 80 according to the present embodiment is similar to that of the first embodiment illustrated in FIG. 4, and the color mixing evaluation pattern 80 includes patches 82 of nine color combination patterns for each combination of two colors recorded respectively at three different level settings for the relative conveyance velocity V and the fixing energy E.

Figure 11A:
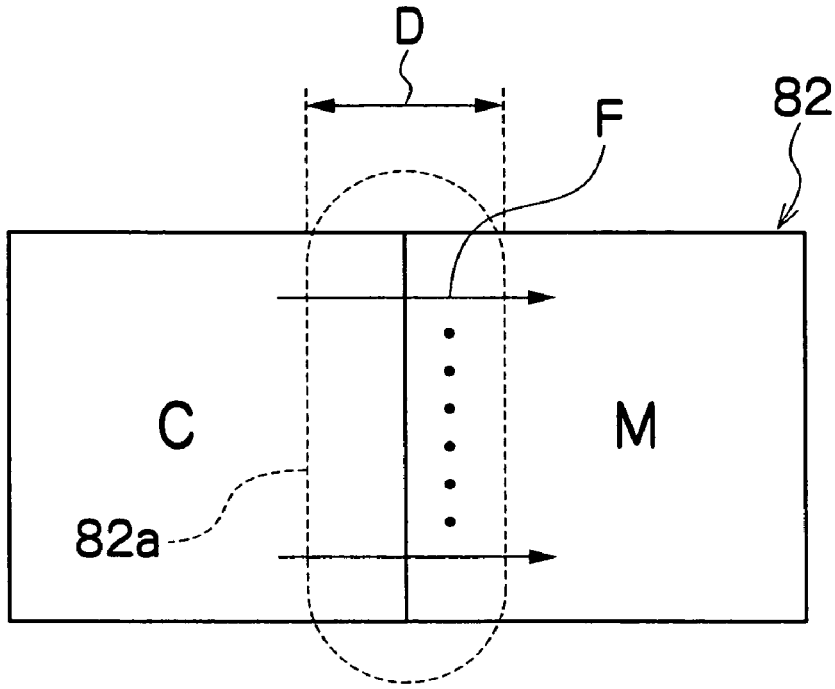
FIG. 11A is an illustrative diagram showing respective patches of a color mixing evaluation pattern.
Figure 11B:
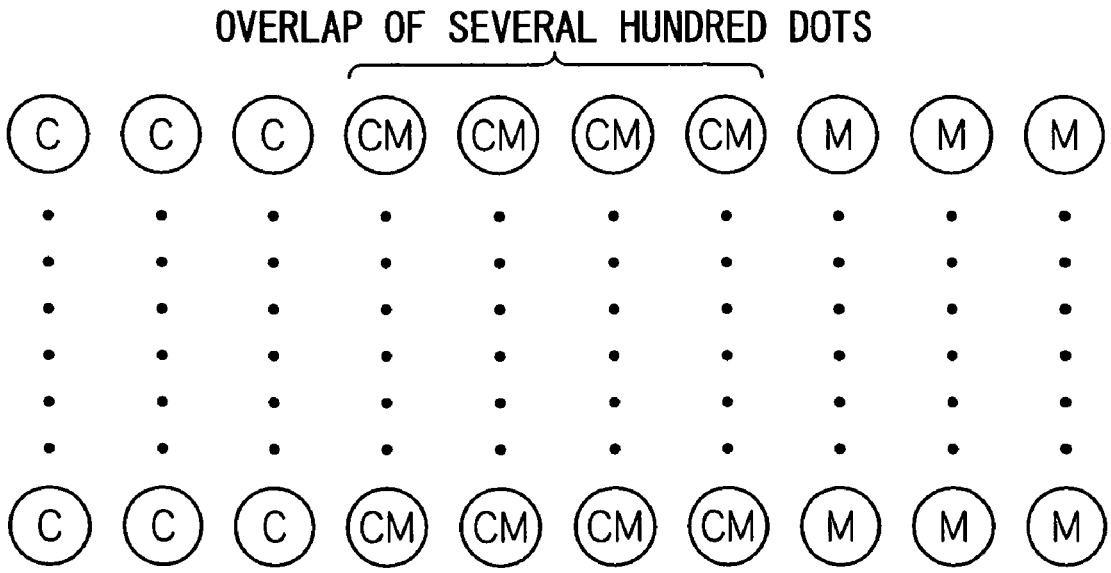
FIG. 11B is an illustrative diagram showing an enlarged view of a boundary region in same.

The patches 82 of the color mixing evaluation pattern 80 comprise two colors (for example, C and M) arranged in a left/right fashion as shown in FIG. 11A, and the color patches are printed (recorded) in a square shape. In particular, at the boundary region 82*a* between the two colors, several hundred dots are printed in an overlapping fashion in order to evaluate color mixing, as illustrated by the enlarged view in FIG. 11B. The mode of color mixing between two inks of different colors is similar to that shown in FIG. 6.

Figure 12A:
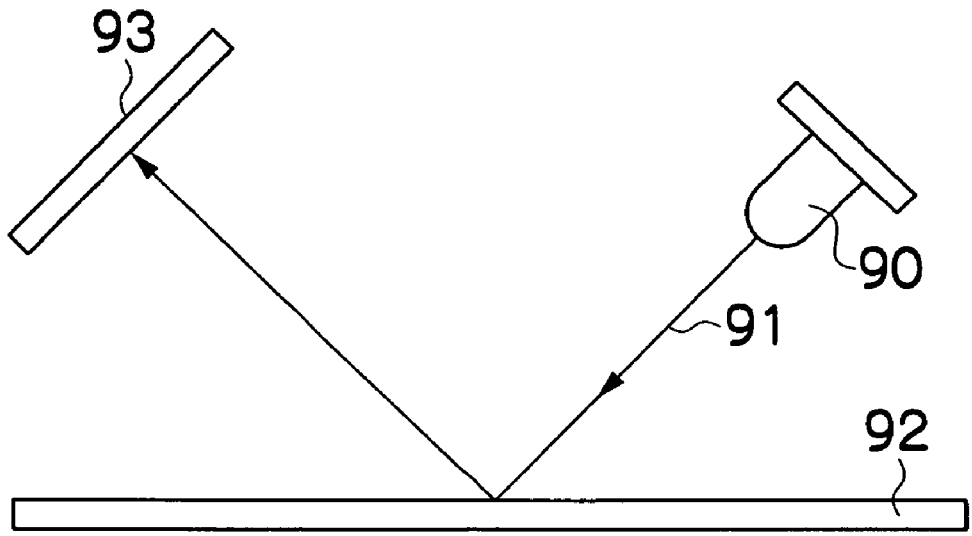
FIGS. 12A and 12B are illustrative diagrams indicating the principle of density measurement.
Figure 12B:
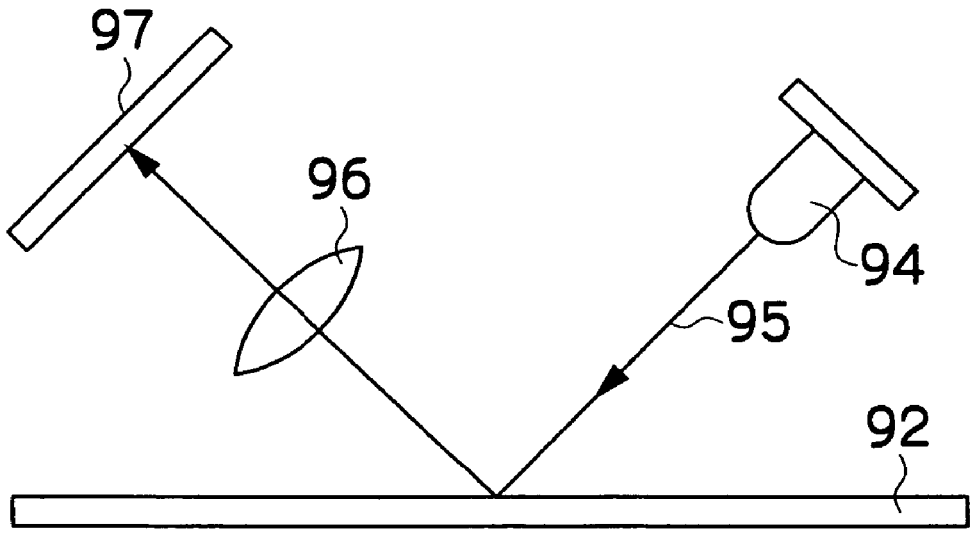

Next, the densities of the patches 82 of the respective color mixing evaluation patterns 80 are measured by means of a densitometer 245. FIGS. 12A and 12B show the principle of density measurement. For example, according to the composition shown in FIG. 12A, a fine light spot 91 irradiated from an RGB light emitting element 90 is directed onto a measurement point on the medium 92, and the light reflected by the medium is received by a photoreceptor 93, such as a CCD element, whereby the density of the fine region can be measured. In this case, the RGB light emitting element may be composed, for example, by combining R, G and B filters with a halogen lamp. Alternatively, as shown in FIG. 12B, for example, a light beam 95 irradiated from an RGB light emitting element 94 may be directed onto a measurement point of the medium 92, the reflected light being condensed onto an area CCD 97 by means of a lens 96 in such a manner that the density can be measured.

This measurement is carried out by dividing the boundary region 82*a* between two colors into N segments in the vertical direction, as illustrated in FIG. 11A (for example, 10 equal segments), and then scanning from left to right as indicated by the arrow F. More specifically, the density is measured by performing fine scanning at a width of approximately 50 μm to 100 μm over a region approximately three times the size of the dot overlap region (see FIG. 11B), in the left-right direction, as indicated by the arrow D in FIG. 11A.

The measurement results from the densitometer 245 are supplied to the parameter setting device 246. One result of measuring the density of patches 82 in the color mixing evaluation pattern 80 is shown by the graph in FIG. 13. A graph of this kind showing a density profile is obtained for each scan in the direction of arrow F in FIG. 11A. The solid lines indicate the density when color mixing (bleeding) has occurred between the C ink and the M ink, and the single-dotted lines indicate the density in ideal conditions where there is no color mixing.

The parameter setting device 246 calculates the distance d between the 60% density point $P_M$ with respect to the maximum density of M, Mmax, and a prescribed threshold value, for instance, the 60% density point $P_C$ with respect to the maximum density of C, Cmax, and for each patch 82, it calculates the standard deviation ad and the average av(d) of the distances d obtained in the respective scans performed at the N equidistant positions in the vertical direction (namely, 10 or more equidistant positions).

Figures 13, 14:
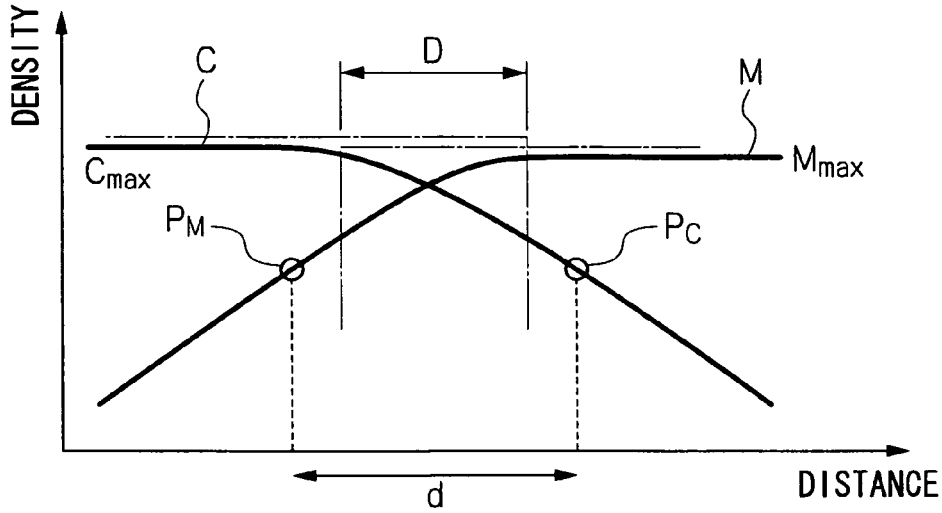
FIG. 13 is a graph showing density profiles measured by a densitometer in the respective patches of the color mixing evaluation pattern.
FIG. 14 is an illustrative diagram showing a method for evaluating color mixing by means of density measurement.

Thereupon, as shown in FIG. 14, the parameter setting device 246 sets the combination of conveyance velocity V and fixing energy E which achieves a minimum for at least one of the standard deviation ad or average av(d) thus calculated, as the optimal parameters for those two ink colors on the recording paper 216, and it stores these parameters in association with the type of recording paper 216 and the ink type.

Here, the combination of the conveyance velocity V and the fixing energy E at which the standard deviation ad becomes a minimum is selected because it is considered to be linked to perceptible color mixing. The combination at which the average value av(d) becomes a minimum is selected because the decline in image resolution caused by color mixing is thought to be reflected in the average value av(d). In this way, it is possible to reduce color mixing to a minimum.

Accordingly, by setting the energy E (fixing energy or curing energy) and the conveyance velocity V at which color mixing is a minimum, then even if the print head separation distance S is uniform, it is still possible to satisfy the conditions SN>t1 or SN>t2, in relation to the fixing time t1 based on the fixing energy E and the curing time t2 based on the curing energy E.

Below, the action of the present embodiment is described with reference to the flowchart in FIG. 15.

Figure 15:
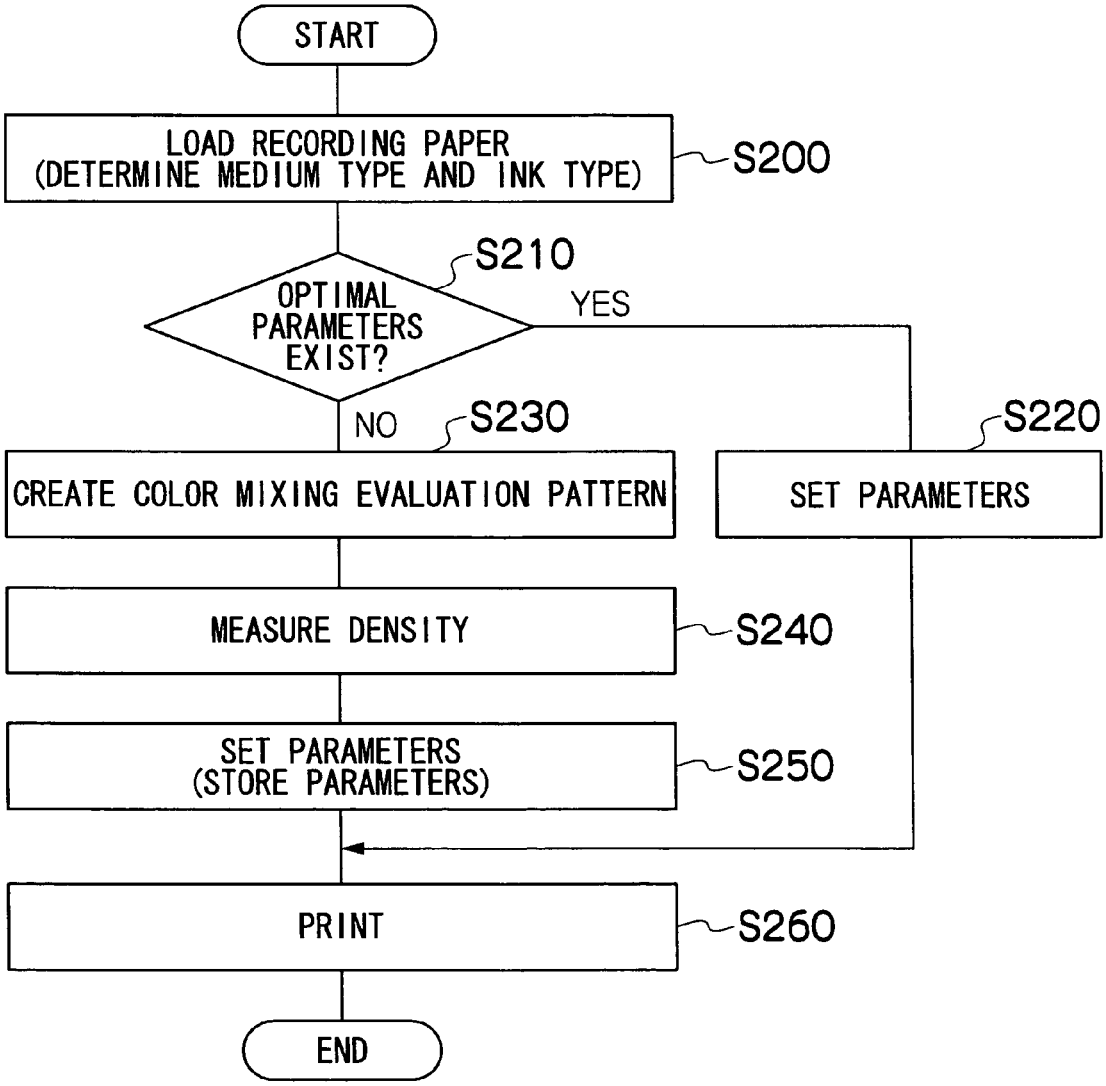
FIG. 15 is a flowchart illustrating the action of the third embodiment.

Firstly, at step S200 in FIG. 15, a magazine 222 for supplying recording paper 216 is loaded into the inkjet recording apparatus 210. As stated previously, an information recording body storing information such as the type of loaded recording paper 216 is attached to a medium type determination notch 222*a* on the magazine 222, and this information is read in by the medium type determination device 225. The information read in by the medium type determination device is supplied to the parameter setting device 246. On the other hand, the ink type is determined by the ink type determination device 228 and the information on the ink type thus determined is also supplied to the parameter setting device 246.

At the next step, S210, the parameter setting device 246 judges whether or not optimal parameters corresponding to the supplied medium type information, or the like, have already been set or stored. If there exist optimal parameters corresponding to the medium type, or the like, then the procedure advances to step S220, and the optimal parameters (conveyance velocity V, fixing (curing) energy E) stored in the parameter setting device 246 are called up and set respectively in the conveyance control device 240, the fixing control device 242 and, if necessary, the head separation distance control device 238.

On the other hand, if no optimal parameters exist corresponding to the determined medium type, or the like, then the procedure advances to step S230 in order to create a color mixing evaluation pattern for establishing optimal parameters. If an information recording body is not attached to the magazine 222, or if one is attached but it cannot be read by the medium type determination device 225, then a dummy medium type is sent to the parameter setting device 246, for example, and it is supposed that no corresponding optimal parameters exist. The procedure then advances to step S230.

At step S230, various patches are outputted by the mutually adjacent print heads (212Y and 212C, 212C and 212M, 212M and 212K) at a plurality of different levels of the conveyance velocity V and the fixing energy E, in accordance with the method described above. Thereby, a color mixing evaluation pattern such as that illustrated in FIG. 10 is created.

Next, at step S240, the density of the respective patches of the color mixing evaluation pattern, and especially the boundary regions, is measured by the densitometer 245, and density profiles such as that shown in FIG. 13 are obtained. The measured density profiles are supplied to the parameter setting device 246.

Next, at step S250, by referring to the density profiles as described above, the parameter setting device 246 identifies the combination of conveyance velocity V and fixing energy E which achieves a minimum standard deviation in the distance between the points of 60% density with respect to the maximum density for each color, and it sets and stores the identified combination as optimal parameters.

Thereupon, at step S260, image recording (printing) is carried out using these optimal parameters. Furthermore, if it is judged that optimal parameters exist at step S210, and if these optimal parameters have been set at step S220, then printing is carried out at step S260.

In this way, according to the present embodiment, optimal parameters for preventing color mixing are previously established in accordance with the type of recording medium and the type of ink, and hence color mixing can be prevented readily, simply by determining the type of recording medium, and the like, at a later stage. Furthermore, even if it is not possible to determine the type of recording medium, by creating a color mixing evaluation pattern, optimal parameters can be set for achieving high-speed recording while preventing color mixing, and therefore color mixing can readily be avoided.

Furthermore, in the present embodiment, a method such as the following can be used for the processes after measuring the density of the color mixing evaluation pattern 80 with the densitometer 245.

In other words, the data measured by the densitometer 245 similarly to the foregoing description is supplied to the parameter setting device 246, and the standard deviation ad and the average value av(d) of the distances d is calculated by the parameter setting device 246. Thereupon, the parameter setting device 246 specifies target values for the standard deviation ad and average value av(d) for the distances d thus calculated, (for example, in the case of the average distance, a target value of two times the overlap length D as illustrated in FIG. 11A or FIG. 13), as well as correction factors a1 and a2, and weighting factors b1 and b2. The target values, correction factors and weighting factors are stored in a mutually associated fashion, as illustrated in FIG. 16.

Here, for example, respective values are specified for the weighting factors, b1 and b2, in accordance with different modes, namely, a mode where a combination of text data and image data is recorded, and a mode where only image data is recorded, as illustrated in FIG. 17. For example, in a mode where both text and images are to be recorded, the weighting factors b1 and b2 are equal, namely, b1=b2=1, whereas in image only mode, the weighting factor b1 is set to a larger value, namely, b1=2 and b2=1.

These values are then used to evaluate color mixing by means of the following color mixing evaluation function f:

$$f=\sigma d\times a1\times b1+|av(d)-D|\times a2\times b2.$$

In other words, the value of this color mixing evaluation function f is taken as an evaluation value for evaluating color mixing, and the smaller this value, the lower the identified level of color mixing. Therefore, the parameter setting device 246 sets the combination of relative conveyance velocity V and fixing energy E which corresponds to the patch 82 producing the lowest f value in this color mixing evaluation function, as the optimal parameters for avoiding color mixing.

Furthermore, as described previously, besides using a method where a color mixing evaluation pattern is created and used to establish optimal parameters for avoiding color mixing in accordance with the type of recording medium by satisfying the inequality S/V>t1 or S/V>t2, it is also possible to avoid color mixing by controlling the head separation distance S ($S_{CY}$, $S_{MC}$, $S_{KM}$), the conveyance velocity V, and the fixing time t1 or the curing time t2 (the fixing energy or the curing energy), directly, in such a manner that the aforementioned inequalities are satisfied. In this case, the relationship between fixing energy and fixing time t1, or the relationship between curing energy and curing time t2 is previously established with respect to various types of recording medium.

The head separation distances S (namely, the distance $S_{CY}$ between print heads 212Y and 212C, the distance $S_{MC}$ between print heads 212C and 212M, and the distance $S_{KM}$ between print heads 212M and 212K) are controlled by the head separation distance control device 238. For example, if the fixing time t1 is established definitely, and the conveyance velocity V is to be increased in order to raise the recording velocity, then it becomes necessary to increase the head separation distances S.

Furthermore, if the print heads 212Y and so on are constituted by long line heads corresponding to the full breadthways direction of the recording paper 216, then it is possible to arrange the heads in such a manner that the head separation distances S increase toward the downstream side in the conveyance direction, in accordance with the decline in the osmotic pressure of the recording paper 216. Moreover, it is also possible to enhance drying by controlling the fixing and curing devices 220 by means of the fixing control device 242, in accordance with the amount of ink permeating into the recording paper 216.

Furthermore, the slower the permeation and drying of the ink and the greater the fixing time of the ink used in the head, or the greater the amount of curing energy required to cure the ink used in the head, the more preferable it becomes to arrange the print heads 212Y, 212C, 212M and 212K toward the upstream side in the conveyance direction. Moreover, if the head separation distances S or the conveyance velocity V are varied, then it is desirable to control the discharge frequency of the print heads 212Y, 212C, 212M and 212K, in such a manner that the desired dot pitch is obtained in the recorded image. The discharge frequency can be controlled by means of a frequency control device 244, in response to conveyance velocity information supplied by the conveyance control device 240.

In the respective embodiments described above, the nozzle groups are formed into respective print heads or respective nozzle rows corresponding to different ink colors, and color mixing between the inks on the surface of the recording medium can be prevented by controlling the time difference between the ink discharge timings of the respective print heads or the respective nozzle rows, in such a manner that this time difference is greater than the ink absorption time between respective print heads or respective nozzle rows.

Furthermore, various specific control methods are possible for making the discharge time difference greater than the ink absorption time, for instance: a method in which the print heads (nozzles rows) are arranged at print head separation distances whereby the conveyance time of the recording medium from one print head to the next print head is equal to or greater than the ink absorption time; a method in which fixing energy, or curing energy for hardening a curable ink such as UV ink or a solid ink, is applied in such a manner that the ink becomes fixed within the conveyance time of the recording medium between respective print heads (nozzle rows); or a method in which the relative conveyance velocity of the recording medium is established in accordance with the ink absorption time or ink curing time of the recording medium between respective print heads (nozzle rows). By adopting these methods, it is possible to avoid color mixing between inks on the surface of the recording medium, while also achieving high-speed recording.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a plurality of nozzle rows of respective colors in each of which a plurality of nozzles are arranged independently for each of inks of the respective colors, the plurality of nozzles discharging the inks onto a recording medium;

a conveyance device which performs relative conveyance of the recording medium in a relative conveyance direction relatively with respect to the plurality of nozzle rows; and a fixing device which fixes the inks deposited on the recording medium from the plurality of nozzles, wherein the image recording apparatus records an image by discharging the inks of the respective colors onto the recording medium from the plurality of nozzles during the relative conveyance by the conveyance device, and the image recording apparatus further comprises:

a fixing control device which controls a fixing energy E1 of the fixing device applied to the ink such that the fixing energy E1 is adjusted to vary a fixing time t1 required for the ink discharged from the first nozzle row to become fixed in the recording medium, wherein the fixing control device controls the fixing energy E1 of the fixing device to fix the ink deposited on the recording medium in such a manner that the nozzle row separation distance S between a first nozzle row and a second nozzle row which are positioned adjacently in the plurality of nozzle rows of the respective colors and which discharge the inks in a consecutive fashion, the relative conveyance velocity V of the recording medium in the relative conveyance with respect to the plurality of nozzle rows and the fixing-time t1 satisfy a relationship S/V>t1.

2. The image recording apparatus as defined in claim 1, further comprising a frequency control device which controls a discharge frequency of the nozzle rows of the respective colors in such a manner that the image is recorded with a prescribed dot pitch.

3. The image recording apparatus as defined in claim 1, wherein the nozzle rows constitute line heads for the inks of the respective colors, the line heads being arranged through a length corresponding to a full dimension in a width direction of the recording medium.

4. The image recording apparatus as defined in claim 1, wherein the nozzle rows are arranged independently for each of the inks of the respective colors in a shuttle type head which performs image recording while moving in a movement direction parallel to a width direction of the recording medium, the nozzle rows being aligned in a direction perpendicular to the movement direction of the shuttle type head.

5. The image recording apparatus as defined in claim 1, wherein the nozzle rows are positioned further toward an upstream side in the relative conveyance direction, the slower fixing properties of the inks used in the nozzle rows.

6. The image recording apparatus as defined in claim 1, further comprising:

a color mixing evaluation print output device which outputs a color mixing evaluation print comprising color mixing evaluation patterns including combinations of the inks of two different colors outputted at a plurality of different levels of at least one of the relative conveyance velocity and the fixing energy, in such a manner that the inks of the two colors discharged from adjacent nozzle rows are mutually adjacent or partially overlapping; and a parameter setting device which sets at least one of parameters for controlling the nozzle row separation distance S, the relative conveyance velocity V and the fixing time t1, according to the color mixing evaluation print outputted by the color mixing evaluation print output device.

7. The image recording apparatus as defined in claim 6, wherein the color mixing evaluation pattern is a resolution chart in which the inks of the two colors are outputted repeatedly and alternately in parallel band shapes which are partially overlapping with each other, a width of the band shapes gradually becoming narrower.

8. The image recording apparatus as defined in claim 1, further comprising:

a relative conveyance velocity control device which controls a relative conveyance velocity V of the recording medium in the relative conveyance with respect to the plurality of nozzle rows.

9. An image recording apparatus, comprising:

a plurality of nozzle rows of respective colors in each of which a plurality of nozzles are arranged independently for each of inks of the respective colors, the plurality of nozzles discharging the inks onto a recording medium;

a conveyance device which performs relative conveyance of the recording medium in a relative conveyance direction relatively with respect to the plurality of nozzle rows;

a curing device which cures the inks deposited on the recording medium from the plurality of nozzles, wherein the image recording apparatus records an image by discharging the inks of the respective colors onto the recording medium from the plurality of nozzles during the relative conveyance by the conveyance device, and the image recording apparatus further comprises:

a curing control device which controls a curing energy E2 of the curing device applied to the ink such that the curing energy E2 is adjusted to vary a curing time t2 required for the ink discharged from the first nozzle row to become cured on the recording medium, wherein the curing control device controls the curing energy E2 of the curing device to cure the ink deposited on the recording medium in such a manner that the nozzle row separation distance S between a first nozzle row and a second nozzle row which are positioned adjacently in the plurality of nozzle rows of the respective colors and which discharge the inks in a consecutive fashion, the relative conveyance velocity V of the recording medium in the relative conveyance with respect to the plurality of nozzle rows and the curing time t2 satisfy a relationship $S/V>t2$.

10. The image recording apparatus as defined in claim 9, comprising the relative conveyance velocity control device, and further comprising a frequency control device which controls a discharge frequency of the nozzle rows of the respective colors in such a manner that the image is recorded with a prescribed dot pitch.

11. The image recording apparatus as defined in claim 9, wherein the nozzle rows constitute line heads for the inks of the respective colors, the line heads being arranged through a length corresponding to a full dimension in a width direction of the recording medium.

12. The image recording apparatus as defined in claim 9, wherein the nozzle rows are arranged independently for each of the inks of the respective colors in a shuttle type head which performs image recording while moving in a movement direction parallel to a width direction of the recording medium, the nozzle rows being aligned in a direction perpendicular to the movement direction of the shuttle type head.

13. The image recording apparatus as defined in claim 9, wherein the nozzle rows are positioned further toward an upstream side in the relative conveyance direction, the slower curing properties of the inks used in the nozzle rows.

14. The image recording apparatus as defined in claim 9, further comprising:

a color mixing evaluation print output device which outputs a color mixing evaluation print comprising color mixing evaluation patterns including combinations of the inks of two different colors outputted at a plurality of different levels of at least one of the relative conveyance velocity and the curing energy, in such a manner that the inks of the two colors discharged from adjacent nozzle rows are mutually adjacent or partially overlapping; and a parameter setting device which sets at least one of parameters for controlling the nozzle row separation distance S, the relative conveyance velocity V and the curing time t2, according to the color mixing evaluation print outputted by the color mixing evaluation print output device.

15. The image recording apparatus as defined in claim 14, wherein the color mixing evaluation pattern is a resolution chart in which the inks of the two colors are outputted repeatedly and alternately in parallel band shapes which are partially overlapping with each other, a width of the band shapes gradually becoming narrower.

* * * * *